US010753002B2

(12) United States Patent
Goodwin

(10) Patent No.: US 10,753,002 B2
(45) Date of Patent: Aug. 25, 2020

(54) ANODE MOUNT ASSEMBLY

(76) Inventor: Wendell W. Goodwin, Walnut, CA (US)

( * ) Notice: Subject to any disclaimer, the term of this patent is extended or adjusted under 35 U.S.C. 154(b) by 145 days.

(21) Appl. No.: 12/842,910

(22) Filed: Jul. 23, 2010

(65) Prior Publication Data

US 2011/0017589 A1 Jan. 27, 2011

Related U.S. Application Data

(60) Provisional application No. 61/228,111, filed on Jul. 23, 2009.

(51) Int. Cl.
*C23F 13/18* (2006.01)
*C23F 13/08* (2006.01)

(52) U.S. Cl.
CPC ..... *C23F 13/18* (2013.01); *C23F 13/08* (2013.01); *Y10T 29/49947* (2015.01)

(58) Field of Classification Search
CPC ..... C23F 13/02; C23F 13/06; C23F 13/08; C23F 13/10; C23F 13/18
USPC ... 204/196.1, 196.17, 196.3, 196.31, 196.37; 416/244 R, 244 B, 245 A
See application file for complete search history.

(56) References Cited

U.S. PATENT DOCUMENTS 3,232,857 A * 2/1966 Caldwell ..... C23F 13/06 204/196.18
3,952,687 A 4/1976 Brownlie et al.
4,486,181 A 12/1984 Cavil
4,545,332 A 10/1985 Suzuki et al.
4,549,949 A * 10/1985 Guinn ..... C23F 13/10 204/196.18
4,588,385 A 5/1986 Suzuki et al.
4,872,860 A * 10/1989 Meisenburg ..... 440/113
4,948,384 A 8/1990 Bland et al.
4,950,188 A 8/1990 Bland et al.
4,959,033 A 9/1990 Bland et al.
4,971,585 A 11/1990 Bland et al.
4,976,640 A 12/1990 Bland et al.
4,993,979 A 2/1991 Bland et al.
5,006,085 A 4/1991 Bland et al.
5,035,664 A 6/1991 Bland et al.
5,033,983 A 7/1991 Bland et al.
5,035,663 A 7/1991 Bland et al.
5,052,959 A 10/1991 Mondek
5,083,952 A 1/1992 Bland et al.
5,112,260 A 5/1992 Bland et al.
(Continued)

*Primary Examiner* — Alexander W Keeling
(74) *Attorney, Agent, or Firm* — Cislo & Thomas, LLP

(57) ABSTRACT

An anode mount assembly is provided for facilitating rapid replacement of an anode component. The adapter mount assembly can comprise a mount component comprising a component body having at least one mounting aperture disposed therein and at least one protrusion or recess that can engage a recess or protrusion of the anode component for restricting movement of the anode component with respect to the mount component in at least one of a rotational and a translational direction of movement. Further, the anode component can comprise an engagement aperture, and the mounting aperture and the engagement aperture can be configured to receive a fastener for securing the anode component to the mount component and for restricting at least one additional degree of movement of the anode component with respect to the mount component to thereby secure the anode component to the mount component.

19 Claims, 20 Drawing Sheets

(56) References Cited

U.S. PATENT DOCUMENTS

| | | | | |
|---|---|---|---|---|
| 5,524,584 | A | 6/1996 | Wantanabe | |
| 6,099,374 | A | 8/2000 | Watanabe et al. | |
| 6,142,109 | A | 11/2000 | Fukuda et al. | |
| 6,319,080 | B1 | 11/2001 | Watanabe et al. | |
| 6,562,206 | B2 * | 5/2003 | Showcatally | 204/280 |
| 7,121,907 | B2 | 10/2006 | Tateishi et al. | |

* cited by examiner

ANODE MOUNT ASSEMBLY

CROSS-REFERENCE TO RELATED APPLICATIONS

This application claims the benefit of U.S. Provisional Application No. 61/228,111, filed Jul. 23, 2009, the entirety of which is incorporated herein by reference.

BACKGROUND

Field of the Invention

The present inventions relate to sacrificial anodes used on outboard motors or other devices used in corrosive environments. More specifically, the present inventions provide a uniquely configured anode mount adapter system by which an anode component can be quickly and easily removed and replaced, thus reducing the time and cost in maintaining the motor or device.

Description of the Related Art

Certain materials (typically metals and metal alloys) corrode (i.e. rust, pit, deteriorate, etc.) due to various corrosive phenomena. Such corrosive phenomena may include electrochemical corrosion such as galvanic corrosion. Galvanic corrosion occurs when dissimilar materials are in contact with each other, and an electrical circuit is completed. Often, electrolytic solutions complete the electrical connection which causes galvanic corrosion. Electrolytic solutions, which provide mobile charge carriers for the conduction of electrical current, are often provided by water, such as salt water, pond water, or other such solutions.

When dissimilar metals are in contact with each other in a "galvanic series," the more anodic material (i.e. the material with a higher tendency to sacrifice electrons in a galvanic series) will preferentially sacrifice electrons for the less anodic (or more cathodic) material. The electrons which are sacrificed for the cathodic material result in the corrosion or deterioration of the anodic material. Higher carrier mobility in the electrolytic solution may result in an enhanced or accelerated corrosion rate of the anodic material. Anodic materials may corrode at an enhanced or accelerated rate when submerged in electrolytic solutions such as water, including salt water, fresh water, etc.

It is known to provide a sacrificial anode, with higher anodic characteristics than the dissimilar materials which are to be protected, in electrical communication with the dissimilar materials, in order to inhibit or slow the rate of corrosion of the dissimilar materials. Submersible motors, propellers, and lower units are often constructed from dissimilar materials, and submersed in an electrolytic solution such as pond water, lake water, salt water, etc. Due to this combination, the motors, propellers, and lower units may have an enhanced or accelerated rate of corrosion. Thus, such arrangements often require the use of sacrificial anodes to slow or prevent corrosion.

SUMMARY

Typical sacrificial anodes often require multiple assembly steps to install the anode in the desired location. The Applicant has found that in a typical installation, a mechanic must spend approximately 20-25 minutes to remove and replace a single anode for an outboard motor or stern drive.

Because typical outboard motors or stern drives use a pair of anodes, the mechanic must spend nearly 40-45 minutes to replace the anodes.

In order to reduce the time and money required to replace prior art or traditional anodes, there is provided an anode mount assembly that comprises a mount component and an anode component. In some embodiments, the mount component can be formed separately from and mounted onto an engine, device, or other component, such as onto a stern drive or a hydraulic unit (e.g., onto the cylinder of the hydraulic unit). However, the mount component can also be formed monolithically or integrally with the engine, device, or other component, such as with a stern drive or a hydraulic unit (e.g., with the cylinder of the hydraulic unit). The mount component comprises a material that will not tend to corrode, such as stainless steel or aluminum. The anode component comprises a material that is more anodic than the mount component and can thus be used as a sacrificial anode component for the motor or device, such as a stern drive. For example, the anode component can comprise a material such as zinc, magnesium, or aluminum.

In some embodiments, the anode component and the mount component are configured such that interaction of corresponding structure of the anode component and the mount component and a single fastening means can allow the anode component to be quickly and securely mounted onto or dismounted from the mount component. For example, the anode component and the mount component can comprise a cooperating protrusion and recess pair that tends to restrict relative movement. Further, the anode component and the mount component can be further configured to be secured relative to each other using a fastening means, such as a mechanical fastener, screw, bolt, clip, frictional coupling, adhesive, weld, and the like, that restricts at least one other degree of relative movement such that the anode component is securely coupled to the mount component.

For example, the anode component and the mount component can comprise an interrelated pair apertures that cooperate when the anode component is fitted onto the mounting component such that a single fastening means, such as a single screw, can be inserted therein to secure the anode component relative to the mount component. Accordingly, some embodiments provide that the anode component and the mount component cooperate so that only a single fastener is necessary to secure the anode component to the mount component.

The mount component can comprise a component body having at least one protrusion or recess extending from a top surface of the component body. The protrusion or recess can be configured to engage a recess or protrusion of the anode component for restricting movement of the anode component with respect to the mount component in at least one of a rotational and a translational direction of movement. The component body can comprise at least one mounting aperture disposed therein.

For example, the component body can have one, two, three, four, or more mounting apertures. The mounting aperture of the component body can be configured to receive a fastener for securing the anode component to the mount component. The fastener can restrict at least one additional degree of movement of the anode component with respect to the mount component to thereby secure the anode component to the mount component.

In some embodiments, the mount component can comprise a pair of protrusions configured to engage with corresponding recesses of the anode component. The pair of protrusions can extend upwardly from the top surface of the component body. The protrusions can comprise an angled surface for enabling the mount component to draw the anode component toward the top surface of the component body. The component body can be generally cylindrical and the protrusions of the mount component can be disposed adjacent to a circular periphery of the component body. The protrusions of the mount component can extend from a generally central location on top surface of the component body.

Further, the mount component can comprise a protruding portion extending from the top surface about the mounting aperture formed in the component body. The protruding portion can be configured to engage with a recess of the anode component for securing the anode component relative to the mount component. As noted, the mount component can be formed separately from a structure to which the anode mount adapter is attached or bonded. For example, the mount component can comprise at least one fastener aperture that is configured to receive a fastener for mounting the mount component to the structure. In some embodiments, the mount component can be bonded to the structure using an adhesive or other material.

Additionally, in some embodiments, a replaceable anode component is provided for rapid replacement of the anode component. The anode component can comprise a component body having at least one protrusion or recess formed therein. The protrusion or recess can be configured to engage a recess or protrusion of a mounting component for restricting movement of the anode component with respect to the mount component in at least one of a rotational and a translational direction of movement. The component body can comprise at least one engagement aperture disposed therein. For example, the component body can have one, two, three, four, or more engagement apertures. The engagement aperture can be configured to receive a fastener for securing the anode component to the mount component. The fastener can restrict at least one additional degree of movement of the anode component with respect to the mount component to thereby secure the anode component to the mount component.

The anode component can comprise a pair of recesses configured to receive corresponding protrusions of the mount component. The recesses can comprise an angled surface for enabling the anode component to be drawn in toward the mount component. Further, the anode component can comprise an engagement recess disposed about the engagement aperture. The engagement recess can be configured to received a protruding portion extending from the mount component. The component body can be generally cylindrical and the recesses are disposed adjacent to a circular periphery of the component body. Furthermore, the recesses can extend from a generally central location of the component body. Additionally, the anode component can comprise a pair of protrusions configured to engage with corresponding recesses of the mount component.

In accordance with some embodiments, methods of replacing a sacrificial anode component are also provided. For example, some embodiments provide for a method comprising: aligning one or more recesses or protrusions of an anode component against one or more protrusions or recesses of a mount component; engaging the one or more recesses or protrusions of an anode component with the one or more protrusions or recesses of a mount component; aligning an engagement aperture of the anode component with a mounting aperture of the mount component; and coupling the anode component to the mount component by passing a fastener through the engagement aperture and into the mounting aperture.

In some embodiments, the aligning step can comprise aligning a pair of protrusions of the mount component with a pair of recesses of the anode component. Further, the engaging step can comprise engaging a pair of protrusions of the mount component with a pair of recesses of the anode component. The method can further comprise engaging an engagement recess disposed about the engagement aperture of the anode component with a protruding portion extending about the mounting aperture of the mount component.

Accordingly, the mount component and the anode component can be uniquely configured to include one or more registers to restrict relative movement between the mount component and the anode component. The registers can comprise protrusion and/or recesses that can engage each other. In some embodiments, the interaction of the protrusions and recesses of the mount component and the anode component can enable a single fastening means, such as a mechanical fastener, screw, bolt, clip, frictional coupling, adhesive, weld, and the like, to secure the anode component to the mount component. Accordingly, the time required to remove and replace the anode component can be dramatically reduced by using embodiments disclosed herein.

In some embodiments, the mount component can be configured such that a coupling portion, may comprise a protruding section that can engage with the anode component. The coupling portion can comprise a hole. Further, the coupling portion can receive a fastening means, such as a mechanical fastener, screw, bolt, clip, frictional coupling, adhesive, weld, and the like. For example, the protruding section of the mount component can engage with a corresponding aperture and the anode component. Thus, the engagement between the mount component and the anode component can be enhanced by the interaction of the protruding section of the mount component with the aperture of the anode component as well as the coupling of the screw or bolt with the hole of the mount component.

In some embodiments, the mount component can be integrally or monolithically formed with an engine or other component. For example, the mount component could be integrally or monolithically formed on an engine component such as an engine cylinder block, a cylinder head, a cowling, or other external engine part. Further, the mount component could be integrally or monolithically formed with other components such as hydraulic components, engine mount components, and the like. Preferably, the engine or other component with which the mount component is integrally or monolithically formed is exteriorly exposed so as to facilitate access to the mount component during installation and replacement of the anode component.

In some embodiments, the mount component can also be formed to separately from the engine or other components. The mount component may include an attachment means that enables the mount component to be fastened or coupled to the engine or other components, such as those described above (e.g., an engine cylinder block, a cylinder head, a cowling, other engine parts, hydraulic components, engine mount components, and the like). The attachment means can comprise fastening means, such as a mechanical fastener, screw, bolt, clip, frictional coupling, clamp, adhesive, weld, and other coupling mechanisms. For example, the mount component may comprise an engagement structure that can fit onto or around an engine or other component. The engagement structure could be fastened to the engine or other component using a fastening means. The engagement structure could also be fastened onto itself such that the engine or other component is captured thereby with the engagement structure securely fastened to the engine or other component.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
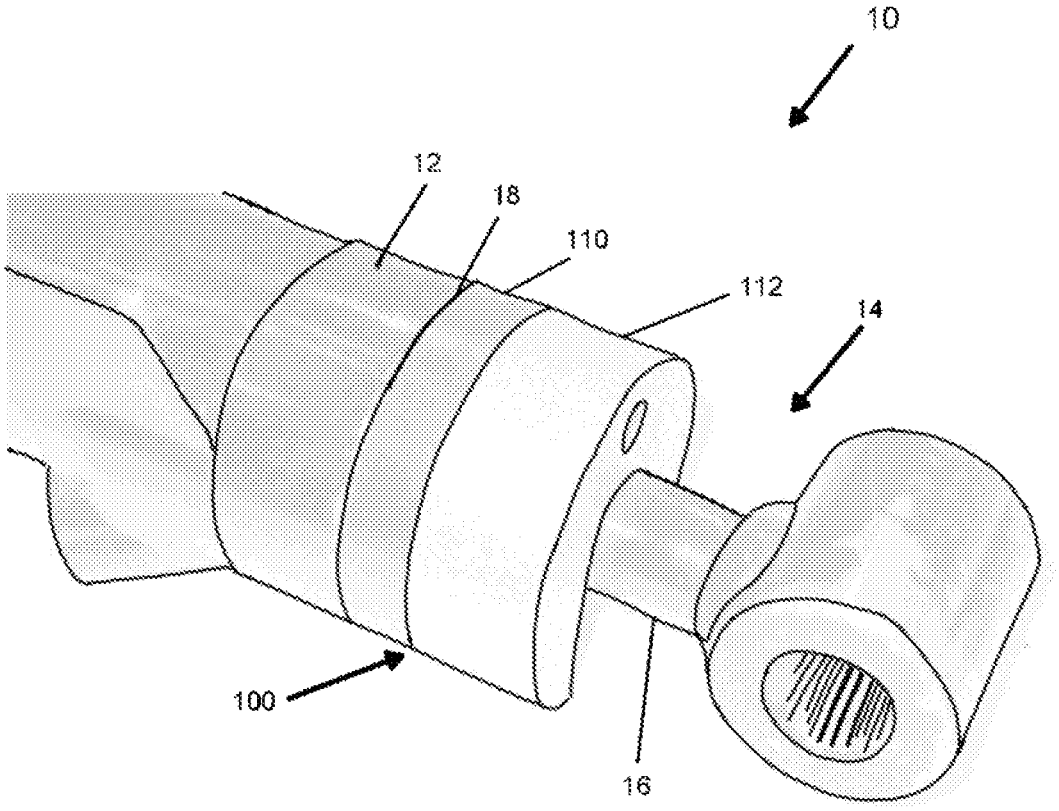
FIG. 1 is a top perspective view of a hydraulic unit and an anode mount adapter assembly, according to an embodiment.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

According to some embodiments, an anode and an anode mount assembly is provided that enables quick and easy mounting of an anode component to another component to mitigate corrosion of a motor or device, such as a stern drive. The assembly can comprise a mount component that can support the anode component. The mount component can be monolithically or integrally formed with another component such as an engine, device, or other component, such as an engine cylinder block, a cylinder head, a cowling, or other external engine part, or other components such as hydraulic components, engine mount components, and the like. However, the mount component can be separately formed and coupled to the other component.

In some embodiments, the anode component and the mount component are configured such that interaction of corresponding structure of the anode component and the mount component and a single fastening means can allow the anode component to be quickly and securely mounted onto or dismounted from the mount component. For example, the anode component and the mount component can comprise a cooperating protrusion and recess pair that tends to restrict relative movement. Further, the anode component and the mount component can be further configured to be secured relative to each other using a fastening means, such as a mechanical fastener, screw, bolt, clip, frictional coupling, adhesive, weld, and the like, that restricts at least one other degree of relative movement such that the anode component is securely coupled to the mount component.

For example, the anode component and the mount component can comprise an interrelated pair apertures that cooperate with each other when the anode component is fitted onto the mounting component such that a single fastening means, such as a single screw, can be inserted therein to secure the anode component relative to the mount component. Accordingly, some embodiments provide that the anode component and the mount component cooperate so that only a single fastener is necessary to secure the anode component to the mount component.

In some embodiments, the anode component can cooperate with the mount component such that the anode component can be coupled to the mount component using one or more fastening means, such as a mechanical fastener, screw, bolt, clip, frictional coupling, weld, registers, interlocking engagement structures, and/or adhesive materials.

In some embodiments, the anode component and the mount component can comprise a plurality of interrelated engagement apertures and mount apertures that are sized and positioned to allow the use of a single fastener to secure the anode component relative to the mount component. For example, each engagement aperture can be paired with a mount aperture such that the single fastener can be inserted into one of a plurality of pairs of engagement and mount apertures. The ability to select a given pair of apertures for use of the fastener can allow greater flexibility and ease of assembly and anode replacement in response to various engine and body arrangements.

Furthermore, the mount component can comprise a material that will not tend to corrode, such as stainless steel or aluminum, and the anode component can comprise a more anodic material that can be used as a sacrificial anode for the motor or device, such as a stern drive. For example, the mount component can comprise a material such as stainless steel or aluminum, and the anode component can comprise a material such as zinc, magnesium, or aluminum.

FIG. 1 is a perspective view of a hydraulic trim-tilt piston-cylinder unit 10. The unit 10 includes a cylinder 12 and a reciprocating piston component 14. The piston component 14 comprises a piston that is disposed within the cylinder 12 and an elongate shaft 16 that extends from the cylinder 12. The reciprocating piston component 14 is attached to a portion of an outboard motor thereby enabling the hydraulic unit 10 to tilt the outboard motor as desired.

FIG. 1 illustrates an embodiment of an anode mount assembly which is formed separately from the engine component or other component, e.g., the hydraulic unit 10. As shown, an anode mount adapter system 100 is mounted onto the hydraulic unit 10. In some embodiments, the anode mount adapter assembly 100 can be formed separately from an engine, device, or other component and can be configured as a retrofit component that can be used with any of engine or other components, such as a variety of hydraulic units. As noted above, the assembly 100 can be used with a hydraulic unit of an outboard motor; however, the assembly 100 can be used with other types of mechanical devices as well, such as a stern drive. More specifically, the assembly 100 can be used with other components that can be subjected to galvanic corrosion and the like.

Figure 2:
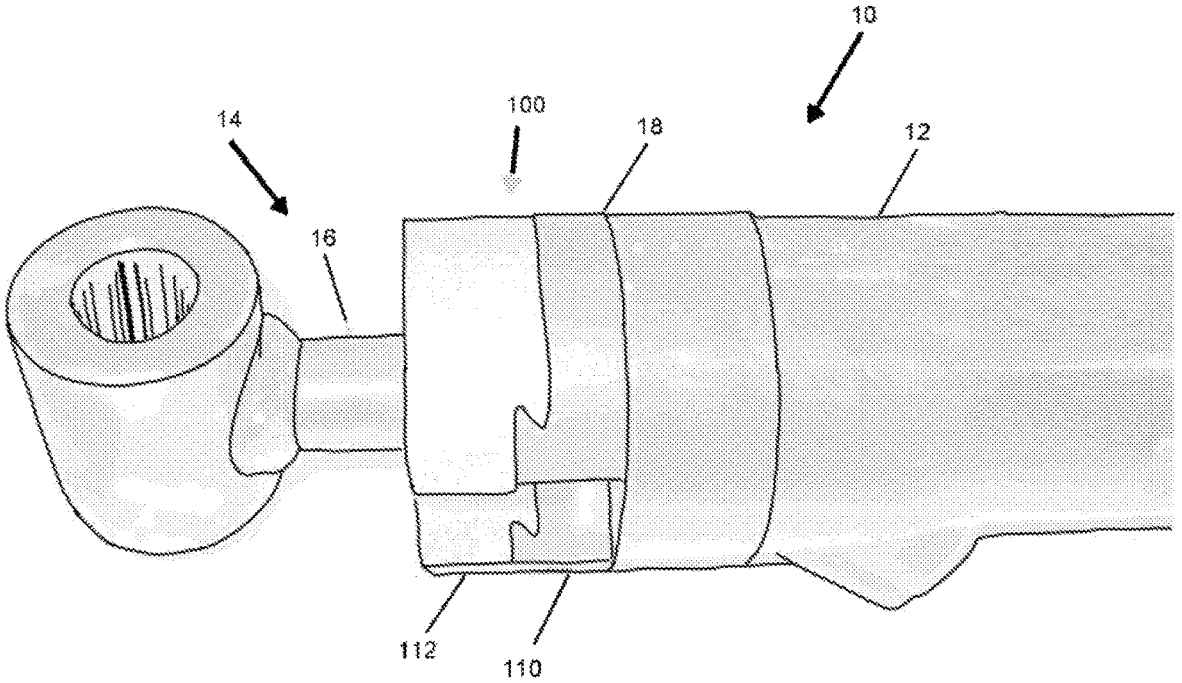
FIG. 2 is a bottom perspective view of the hydraulic unit and anode mount adapter assembly shown in FIG. 1.
Figure 3:
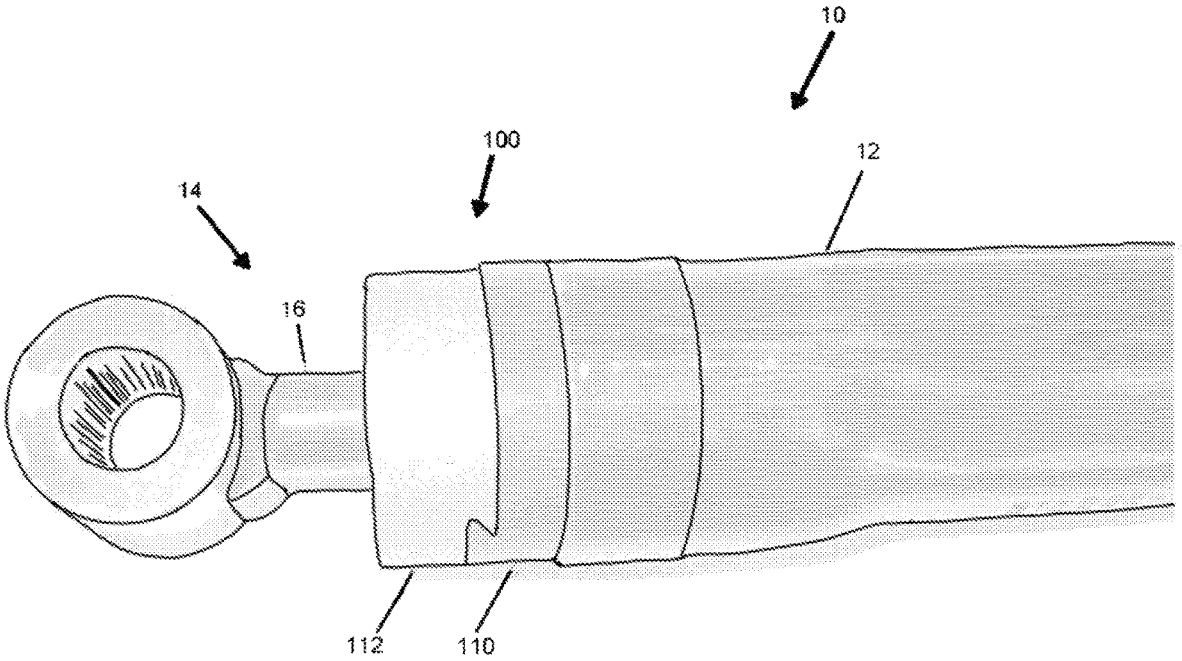
FIG. 3 is a side view of the hydraulic unit and anode mount adapter assembly shown in FIG. 1.
Figure 4:
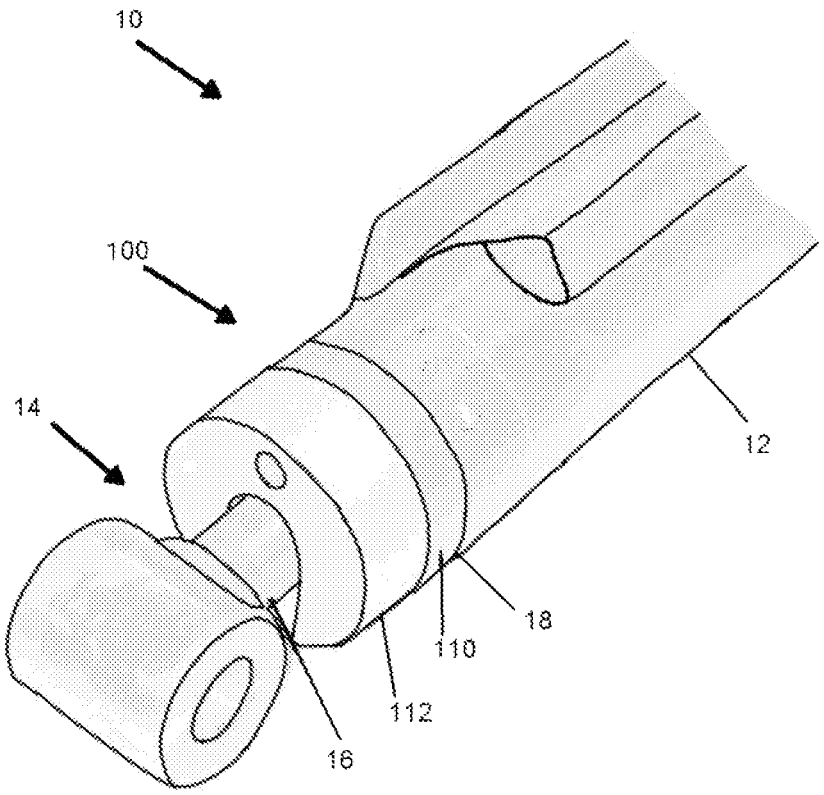
FIG. 4 is a top perspective view of the hydraulic unit and anode mount adapter assembly shown in FIG. 1.

FIGS. 2-4 illustrate other views of the hydraulic unit 10 and the mount adapter system 100. As with FIG. 1, FIGS. 2-4 also illustrate that the anode mount adapter assembly 100 can be mounted to a structure of a device with which the anode can beneficially be used. In many applications, this structure can comprise a component or portion of an outboard motor or other device, such as a stern drive, that is used in conditions that may lead to corrosion of the device in some manner.

In the embodiment of FIGS. 1-4, the mount adapter assembly 100 can be mounted to a distal end 18 of the cylinder 12. In some embodiments, the assembly 100 can be mounted to an end face of the cylinder 12. However, the geometry of the distal end 18 of the cylinder 12 can vary and embodiments of the assembly 100 can be attached to various geometries of the distal end 18.

Referring again to the embodiment illustrated in FIGS. 1-4, the assembly 100 can be attached or bonded to the distal end 18 of the cylinder 12 by a fastening means, such as a mechanical fastener, screw, bolt, clip, clamp, pin, frictional coupling, adhesive, weld, and the like. As will be discussed further below, the assembly 100 comprises a mount component 110 and an anode component 112. In some embodiments, only the mount component 110 is attached or bonded to the distal end 18 of the cylinder 12 and the anode component 112 is then attached to the mount component 110. However, in some embodiments, the anode component 112 can be directly attached to the cylinder 12.

As noted above, in some embodiments, the mount component can be integrally or monolithically formed with an engine, device, or other component, such as an engine cylinder block, a cylinder head, a cowling, or other external engine part. Further, the mount component could be integrally or monolithically formed with other components or devices such as hydraulic components, engine mount components, and the like. In some embodiments, the engine, device, or other component with which the mount component is integrally or monolithically formed is exteriorly exposed to facilitate access to the mount component during installation and replacement of the anode component.

Figure 5:
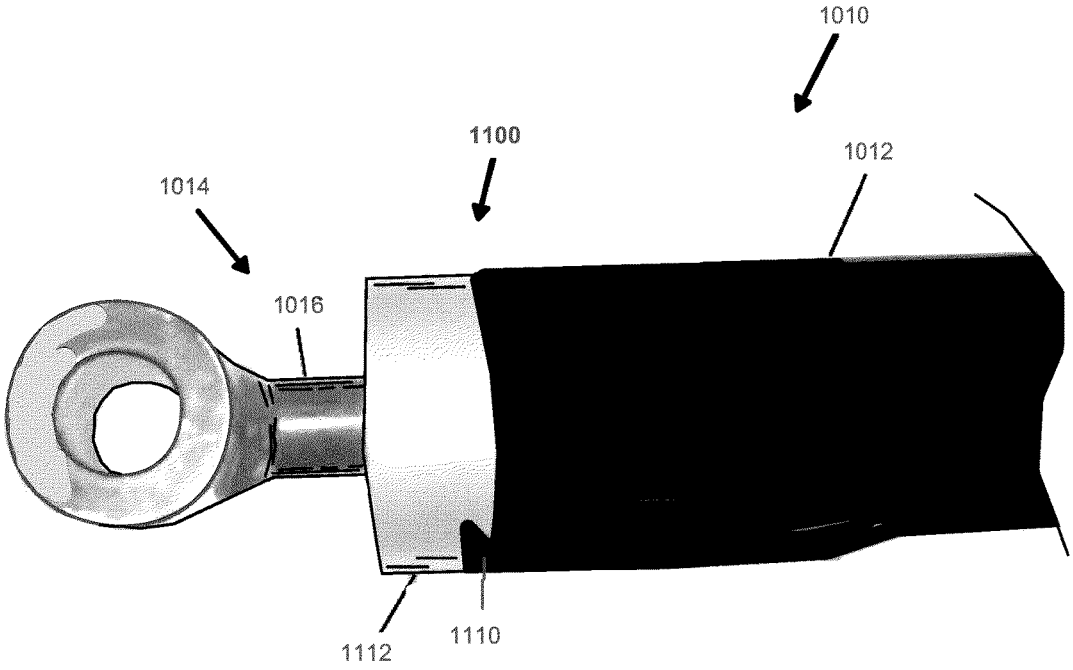
FIG. 5 is a side view of a hydraulic unit having a monolithically formed mount component for coupling with an anode component, according to an embodiment.

An example of such an embodiment is shown in FIG. 5. As shown, a mount component 1110 could be integrally or monolithically formed on a hydraulic unit 1010. The unit 1010 can comprise a piston component 1014, a cylinder 1012, and an elongate shaft 1016 that extends from the cylinder 1012. The hydraulic unit 1010 and the mount component 1110 could be monolithically or integrally formed together as a single unit. Thus, a distal end 1018 of the hydraulic unit 1010 could be configured to be coupled with an anode component. The coupling with the anode component can be performed as described herein.

For the sake of brevity, the coupling of the anode component with the mount component will apply equally whether the mount component is a monolithically formed mount component or a separately formed mount component. Thus, embodiments described herein that illustrate or discuss structures or mechanisms for coupling the anode component with the mount component are intended to be equally applied to a mount component that is a monolithically formed mount component or a separately formed mount component.

Figure 6:
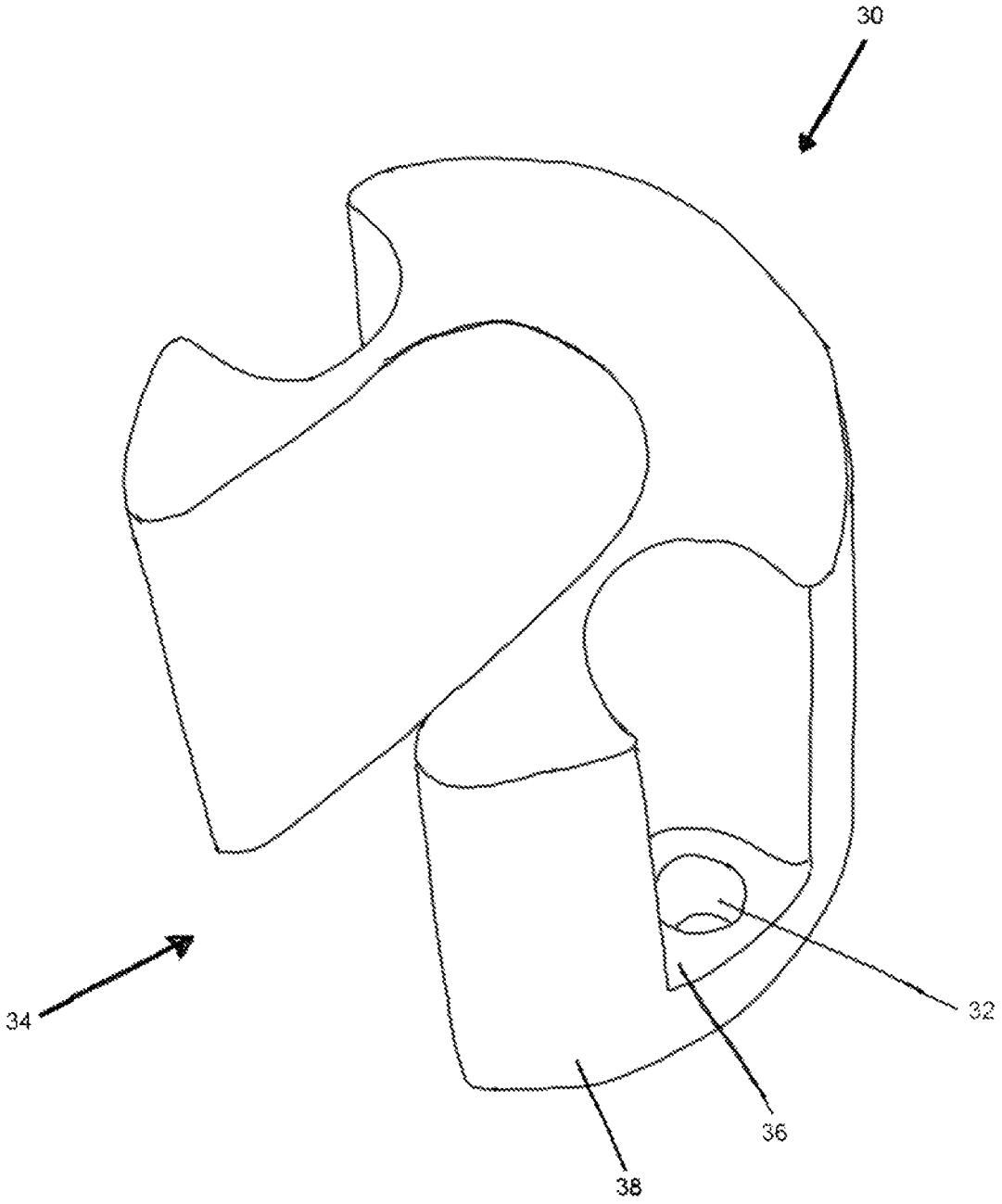
FIG. 6 (PRIOR ART)
FIG. 6 is a perspective view of a prior art anode.

In order to better appreciate the significant improvement provided by embodiments of the anode mount adapter assembly 100, FIG. 6 is provided to illustrate a prior art anode 30 that is adapted to be mounted on a distal end of a hydraulic trim cylinder. The anode 30 is configured to be mounted on a hydraulic trim cylinder that is similar to the configuration shown in FIGS. 1-4. In order to do so, the anode 30 comprises a pair of fastener apertures 32 and a central cavity 34. The fastener apertures 32 pass through a flange 36 located at a distal end 38 of the anode 30. The fastener apertures 32 are disposed on opposing sides of the central cavity 34. In use, the anode 30 is fitted onto a hydraulic trim cylinder by placing the central cavity 34 of the anode 30 over the elongate shaft of the piston component. A pair of screws are then inserted through the fastener apertures 32 in order to bolt the anode 30 onto the distal end of the hydraulic trim unit.

While the prior art anode 30 shown in FIG. 6 may provide protection for an outboard motor, the anode 30 is very difficult to remove and install. The Applicant of the present Application has performed and observed numerous installation procedures using anodes such as that shown in FIG. 6. In general, the Applicant has found that each anode 30 requires approximately 20-25 minutes of mechanic time in order to remove and replace the anode 30. Because most boats use two anodes for each motor, nearly an hour is required to change both anodes. Indeed, although anodes have been in use for numerous years, current anodes still require a significant amount of time to remove and replace the anode.

Accordingly, the Applicant has developed a unique anode mount assembly that allows a mechanic to change an anode within minutes. Indeed, in tests to compare the replacement time of an anode used in the Applicant's anode mount assembly, the amount of time required to replace an anode using an embodiment of the assembly disclosed herein is a 10th of the time required to change prior art anodes. Therefore, embodiments of the assembly disclosed herein represent a significant improvement in the design and use of the anode, as well as a dramatic decrease in the cost and difficulty associated with such maintenance.

Figure 16:
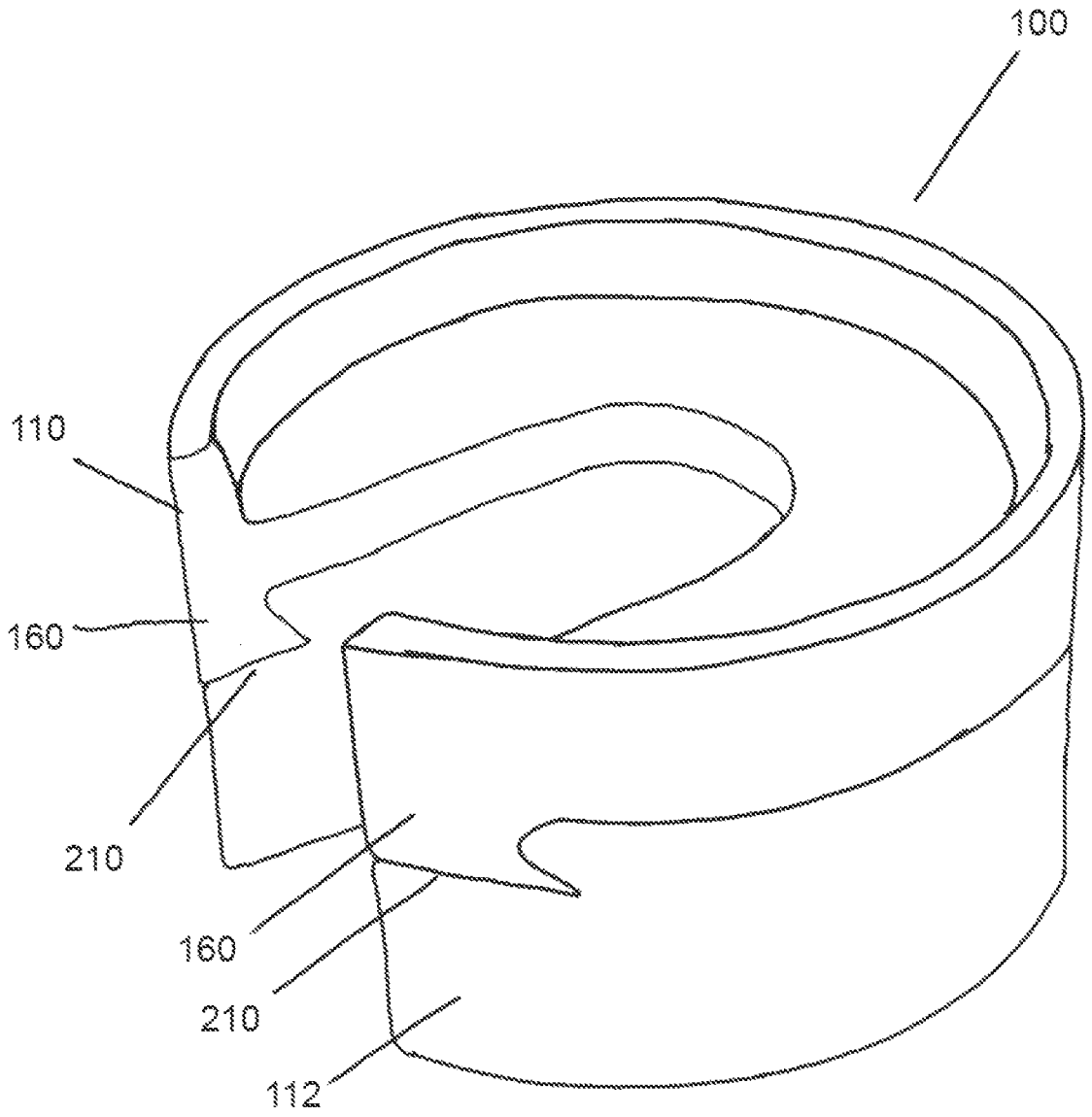
FIG. 16 is a top perspective view of the anode mount adapter assembly, according to an embodiment.
Figure 17:
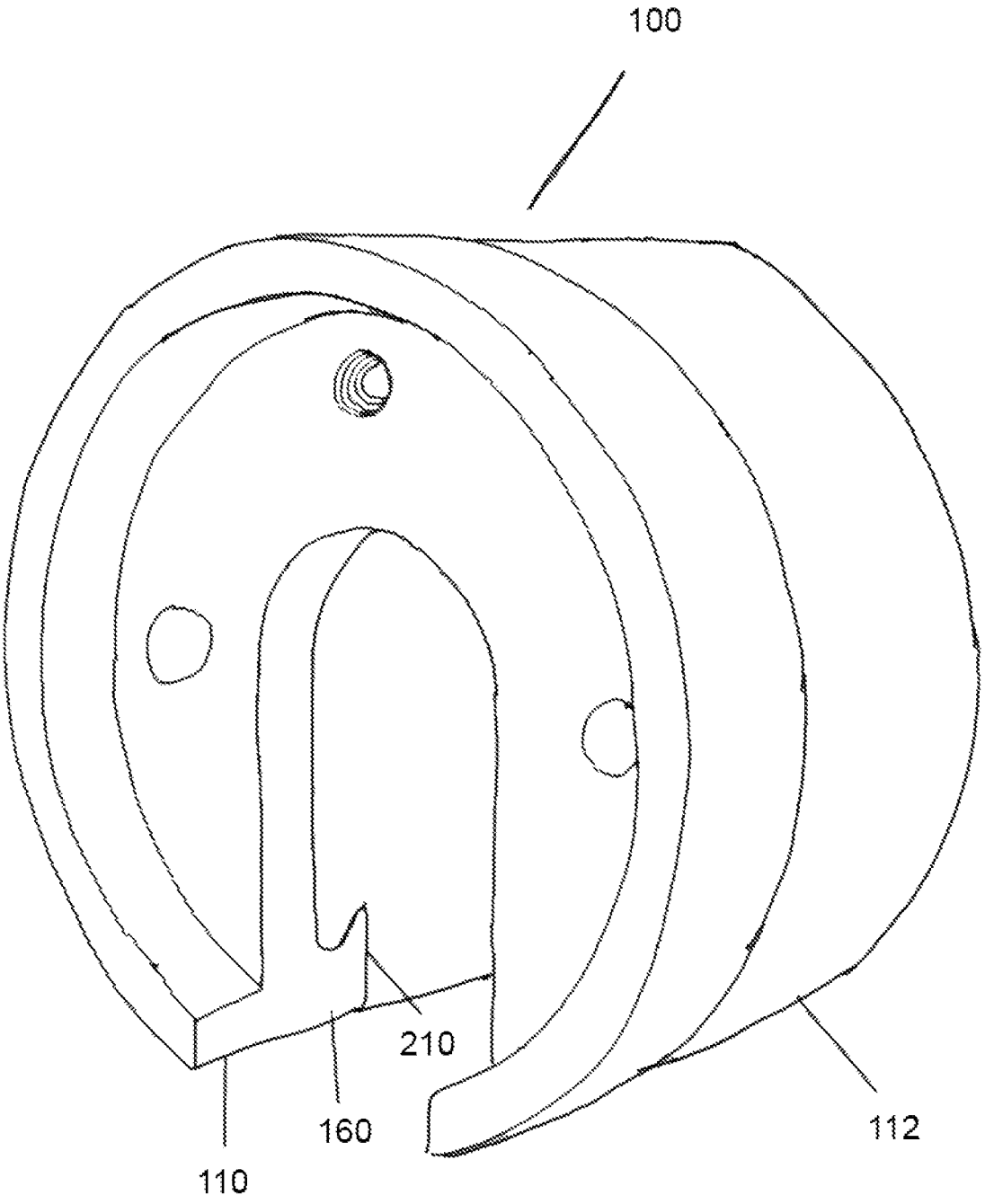
FIG. 17 is a side perspective view of the assembly shown in FIG. 16.
Figure 18:
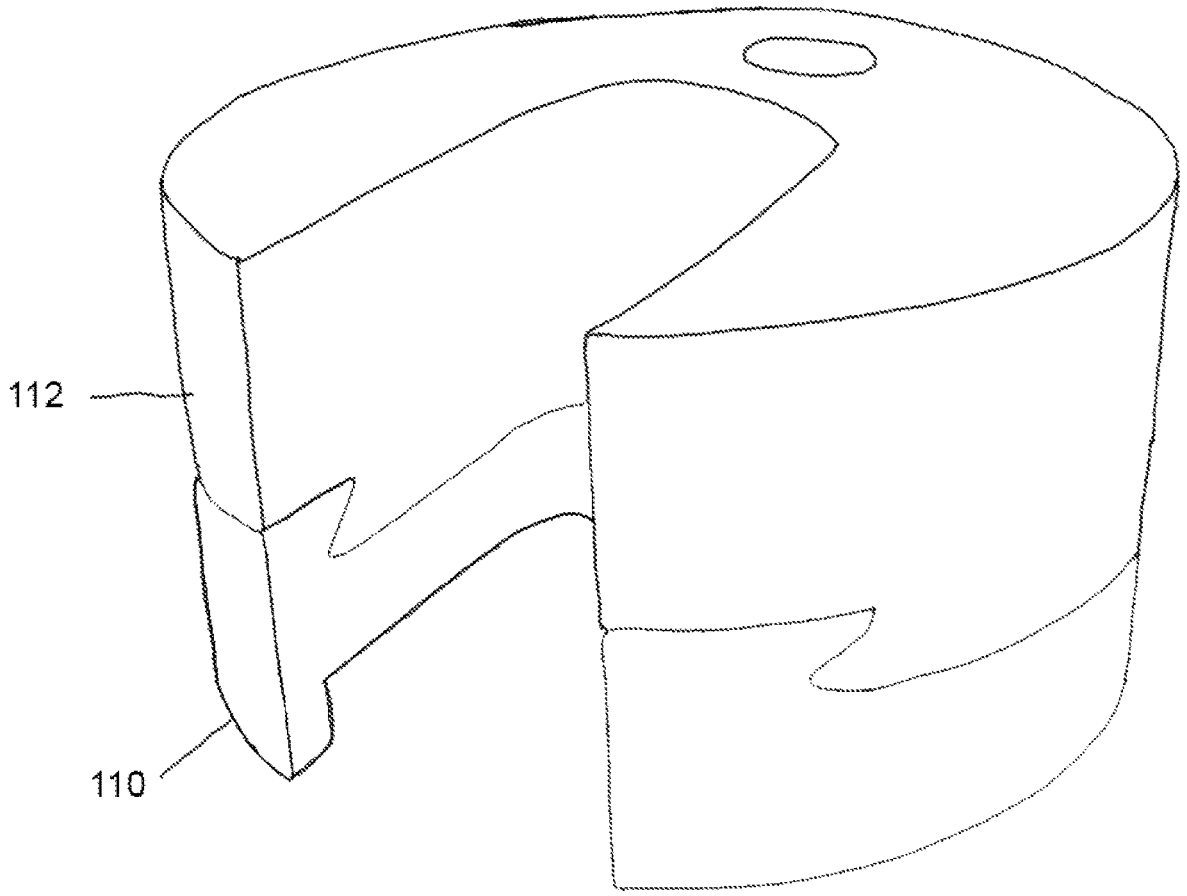
FIG. 18 is a rear perspective view of the assembly shown in FIG. 16.

FIGS. 7-10 illustrate an embodiment of the mount component 110 of the anode mount adapter assembly 100. Further FIGS. 11-15 illustrates various views of an embodiment of the anode component 112 of the anode mount adapter assembly 100. Finally, FIGS. 16-18 illustrate various views of the anode mount adapter assembly 100 in which the mount component 110 is attached or bonded to the anode component 112.

As noted above, although the mount component 110 of FIGS. 7-10 and 16-18 is formed separately from and attachable to an engine, device, or other component, the discussion of the attachment to an anode component also applies for mount components that are formed monolithically or integrally with the engine, device, or other component.

Figure 7:
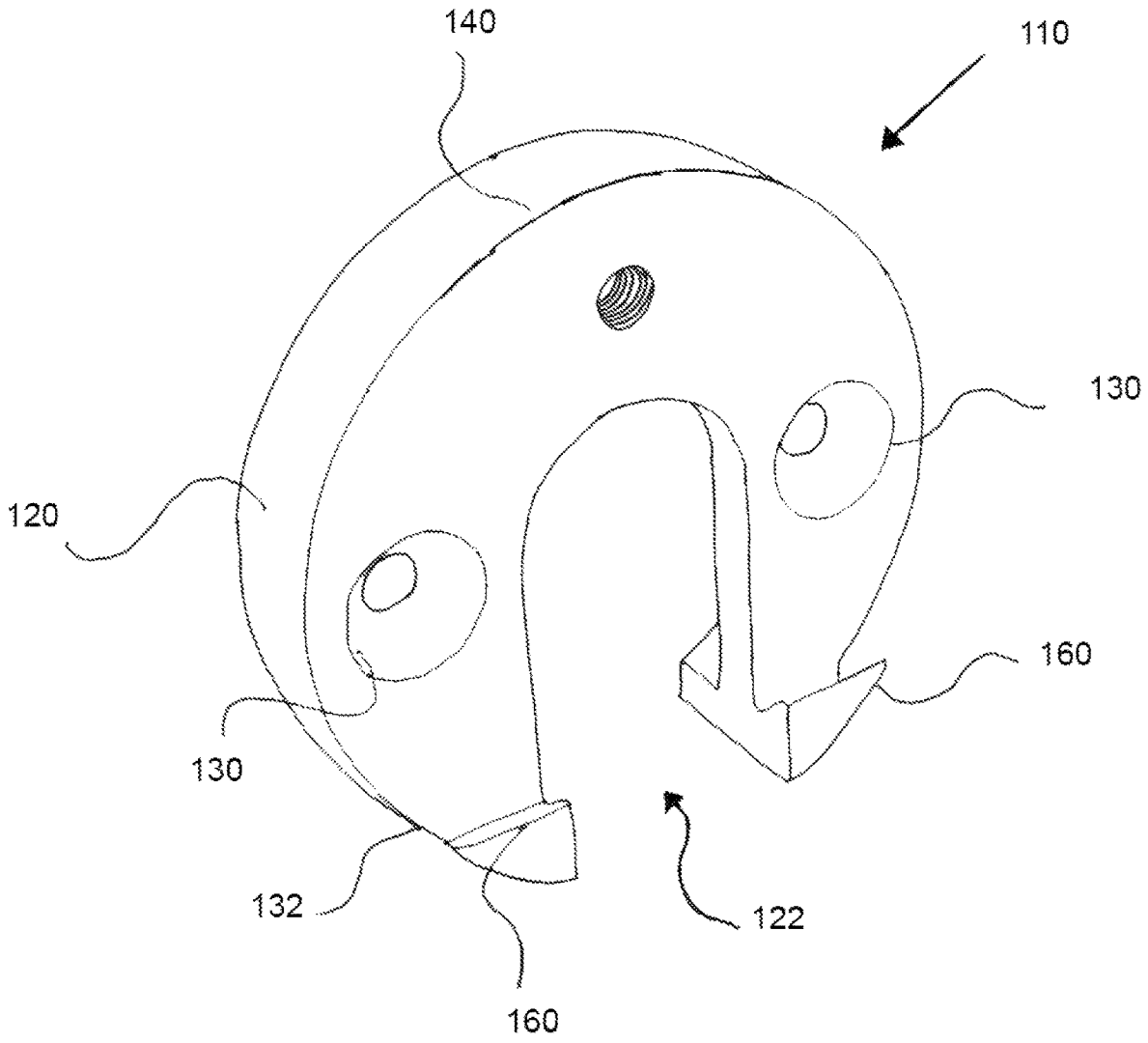
FIG. 7 is a front perspective view of a mount component, according to an embodiment.

Referring initially to FIG. 7, the mount component 110 can comprise a component body 120 and a central void 122. The central void 122 can be configured such that the mount component 110 can be placed over the elongate shaft 16 of the hydraulic unit 10. The embodiment shown in FIGS. 7-10 illustrates a mount component 110 that is formed in a "horseshoe" configuration that allows the elongate shaft 16 to be freely passed into the central portion of the component body 120. However, other configurations of the component body 120 can be utilized that alter the size and/or shape of the central void 122.

The component body 120 can be configured to comprise one or more fastener apertures 130. The fastener apertures 130 are preferably sized and configured to receive a corresponding fastening means, in order to mount the mount component 110 onto the hydraulic unit 10. As shown in FIG. 7, in some embodiments, the fastener apertures can comprise a countersink design such that a fastener is flush with or lies below a top surface 132 of the mount component 110. As such, in some embodiments using a screw, for example, the head of the screw will not tend to interfere with or contact the anode component 112 that can be mounted on the mount component 110.

Additionally, the component body 120 can also comprise one or more mounting apertures 140. The mounting apertures 140 can be configured to receive at least a portion of a fastening means that is used to mount the anode component 112 to the mount component 110. Further, the mounting apertures 140 can comprise a stainless steel or aluminum interior threaded portion in order to facilitate reuse of the mount component 110. The mount component 110 can be formed from any of a variety of desirable noncorrosive materials, and the mounting apertures 140 can be reinforced or comprise threads formed from stainless steel, aluminum, or other such materials that ensure reusability of the threads without becoming stripped. Such a configuration will be illustrated and described further below.

Figure 8:
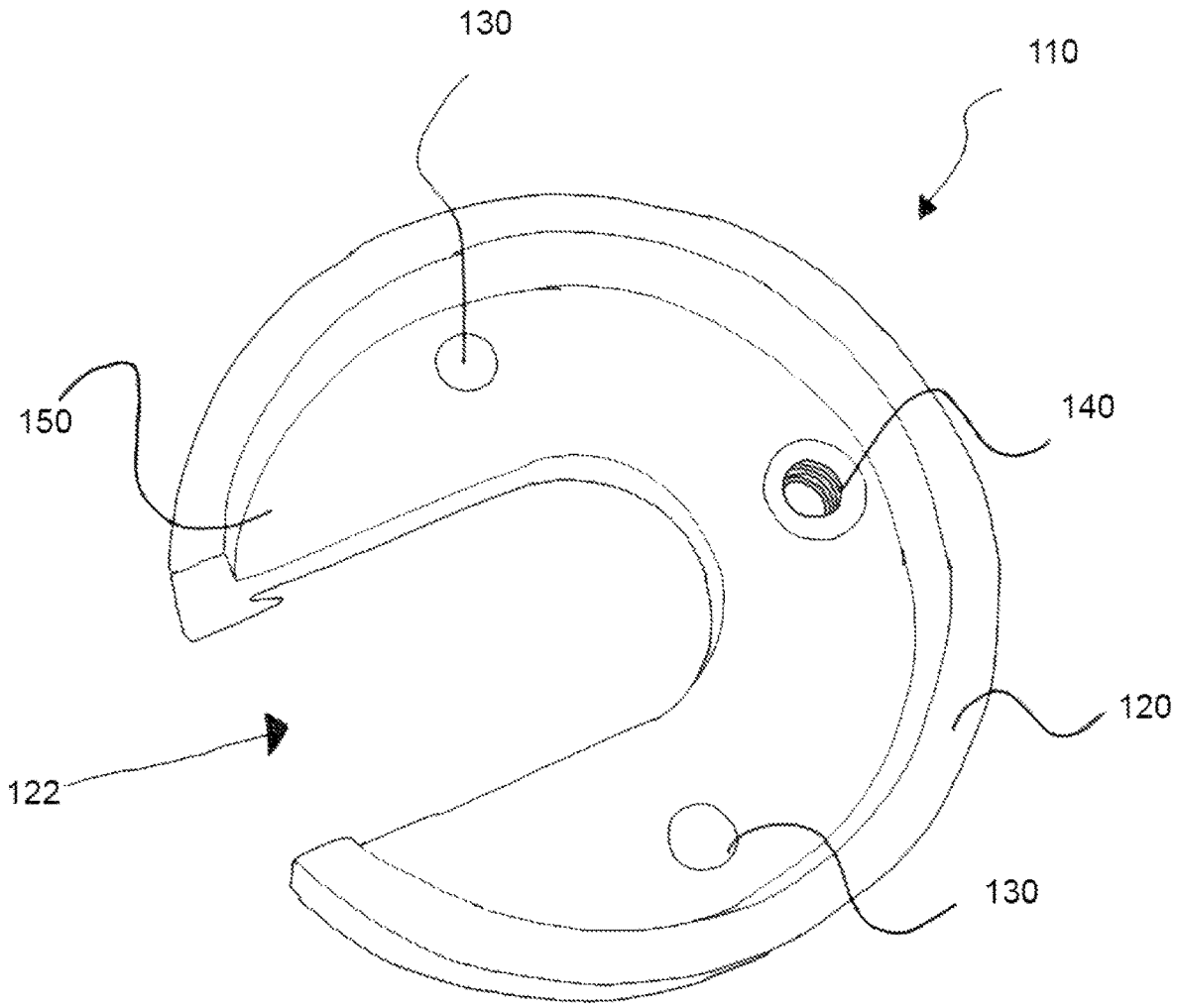
FIG. 8 is a rear perspective view of the mount component shown in FIG. 7.
Figure 10:
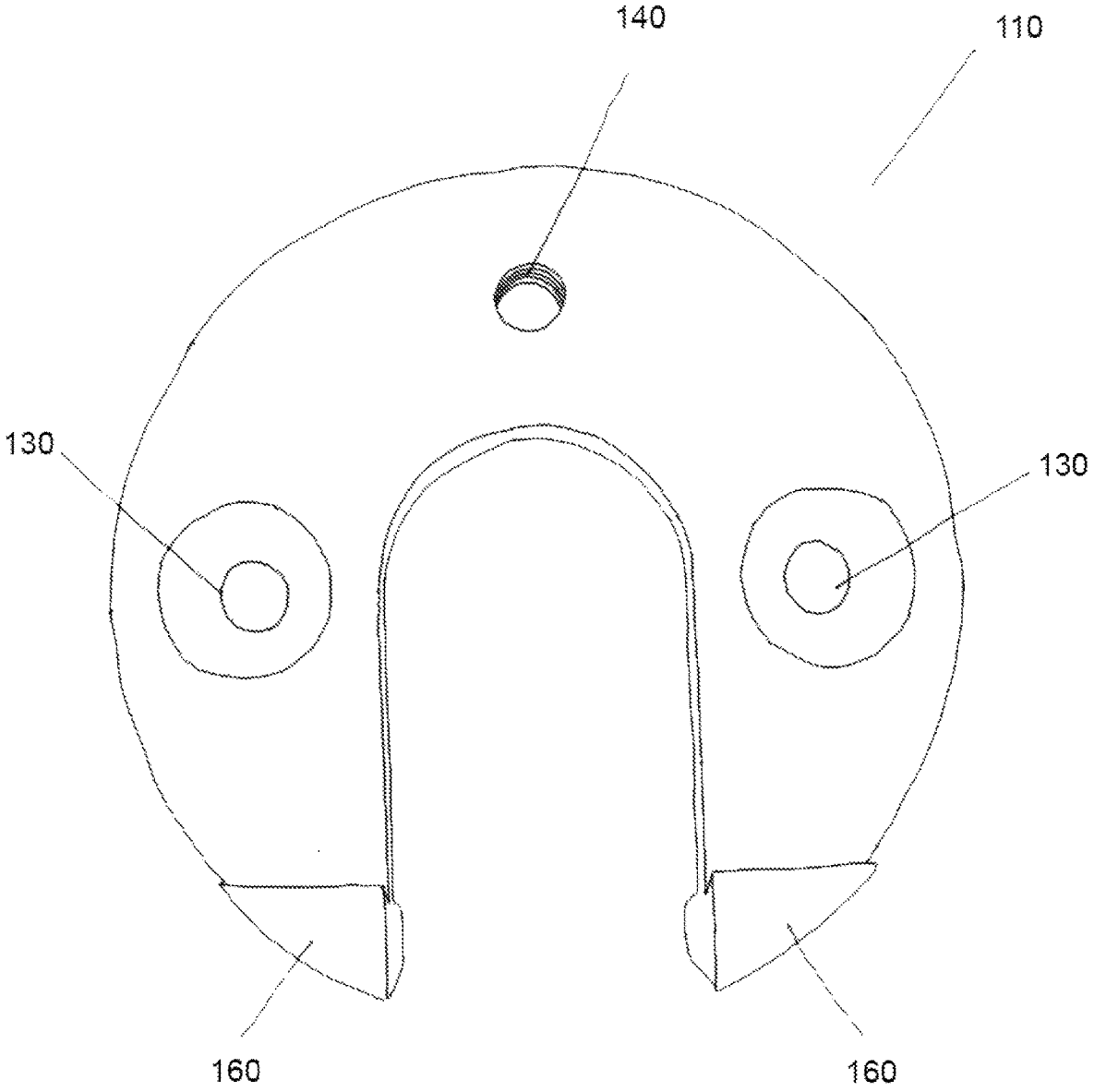
FIG. 10 is a front view of the mount component shown in FIG. 7.

Referring to the rear perspective view of FIG. 8 and the front view of FIG. 10, the fastener apertures 130 and the mounting aperture 140 are shown in a relative positioning on the component body 120 of the mount component 110. As illustrated, the fastener apertures 130 are distributed at opposing sides of the central void 122. However, the fastener apertures 130 can be positioned at other locations. Further, fewer or more fastener apertures 130 can be used in other embodiments.

Additionally, fewer or more mounting apertures 140 can be used. For example, a pair of mounting apertures could be used to mount the anode component 112 to the mount component 110. Additionally, more than one anode component 112 may be used and/or mounted with the mount component 110. Thus, in an embodiment wherein the anode component 112 comprises two portions, each portion of the anode component 112 can include an engagement aperture that allows a fastening means to pass therethrough, and the mount component 110 can comprise a pair of corresponding mounting apertures 140.

FIG. 8 also illustrates that in some embodiments, the component body 120 can comprise an internal cavity 150. The internal cavity 150 can be sized and configured to at least partially receive the distal end 18 of the hydraulic unit 10. However, a periphery 152 the component body 120 can also be configured to abut the distal end 18 of the unit 10 such that the unit 10 is not received within the cavity 150. Accordingly, in such an embodiment, the cavity 150 can still provide the advantage of reducing the weight and manufacturing cost of the mount component 110.

Referring again to FIGS. 7 and 9, the mount component 110 can comprise one or more protrusions 160. The protrusions 160 can be configured to extend upwardly from the top surface 132 of the mount component 110. The protrusions 160 can be used to restrict at least one degree of motion of the anode component 112 mounted to the mount component 110. Thus, the protrusions 160 can comprise one or more surfaces that contact the anode component 112 in order to restrict movement thereof.

Figure 9:
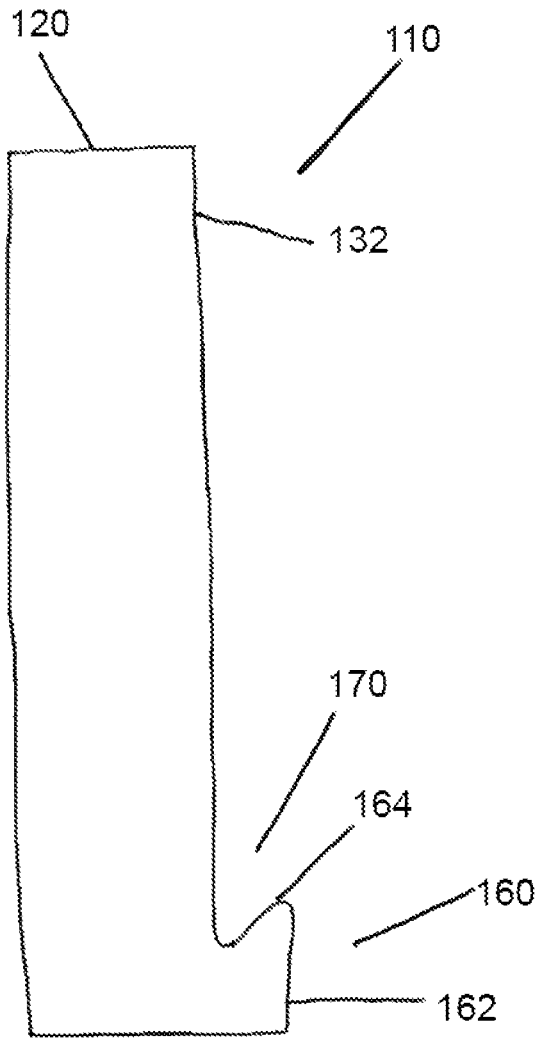
FIG. 9 is a side view of the mount component shown in FIG. 7.

For example, as best illustrated in FIG. 9, the protrusion 160 comprises an upper surface 162 and a side surface 164. In this embodiment, the upper surface 162 is generally parallel to the top surface 132 of the component body 120. However, the side surface 164 can extend transversely relative to the upper surface 162 and the top surface 132. Indeed, as shown in FIG. 9, the side surface 164 can extend at an acute angle with respect to the top surface 132 of the component body 120. Accordingly, as will be described further below, the protrusion 160 can interlock with a corresponding recess in the anode component 112. Due to the angular relationship between the side surface 164 and the top surface 132, as well as the configuration of embodiments of the anode component 112, at least a portion of the anode component 112 can be positioned in an interlocking recess 170 between the protrusion 160 and the top surface 132 of the component body 120.

The unique configuration of such an embodiment can thereby allow the anode component 112 to be received and mounted onto the mount component 110 with great ease. Although an additional fastener can be used in some embodiments to secure the anode component 112 to the mount component 110, the anode component 112 can initially be placed onto and fitted within the interlocking recess 170 which will provide a high level of initial stability between the mount component 110 and the anode component 112 to maintain their positional relationship while the mechanic places a mechanical fastener through the respective mounting aperture(s), fastener aperture(s), and engagement aperture(s) of these components 110, 112.

Figure 11:
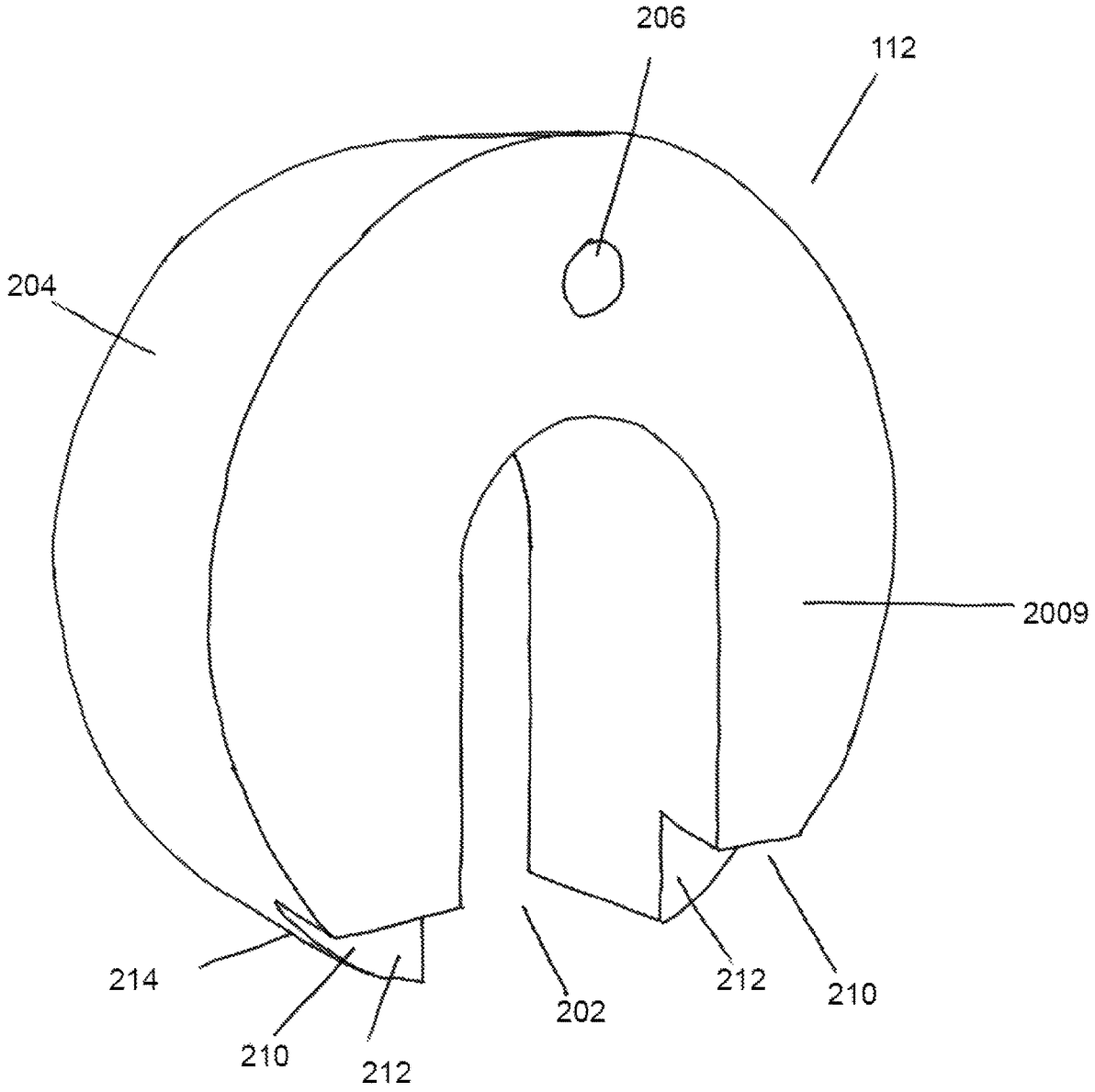
FIG. 11 is a front perspective view of an anode component, according to an embodiment.

Referring now to FIGS. 11-15, an embodiment of the anode component 112 is illustrated. As discussed above, the anode component 112 can be configured to be mounted onto the mount component, whether formed integrally or monolithically or separately from the engine, device, or other component on which the anode component will be supported. FIG. 11 illustrates a perspective rear view of the anode component 112. The anode component 112 can be configured to comprise a rear face 200 and a central void 202 that extends through a component body 204 of the anode component 112. Further, the anode component 112 comprises an engagement aperture 206.

The central void 202 can be configured such that the anode component 112 can be placed over the elongate shaft 16 of the hydraulic unit 10. The embodiment shown in FIGS. 11-15 illustrates an anode component 112 that is formed in a "horseshoe" configuration, similar to the mount component 110 discussed above, that allows the elongate shaft 16 to be freely passed into the central portion of the component body 204. However, other configurations of the component body 204 can be utilized that alter the size and/or shape of the central void 202.

Additionally, the anode component 112 can comprise one or more mounting recesses. The mounting recess can comprise an aperture extending through the body of the anode component 112, a detent on the body of the anode component 112, and/or another structure configured to interlock with a portion of the mounting component.

Figure 12:
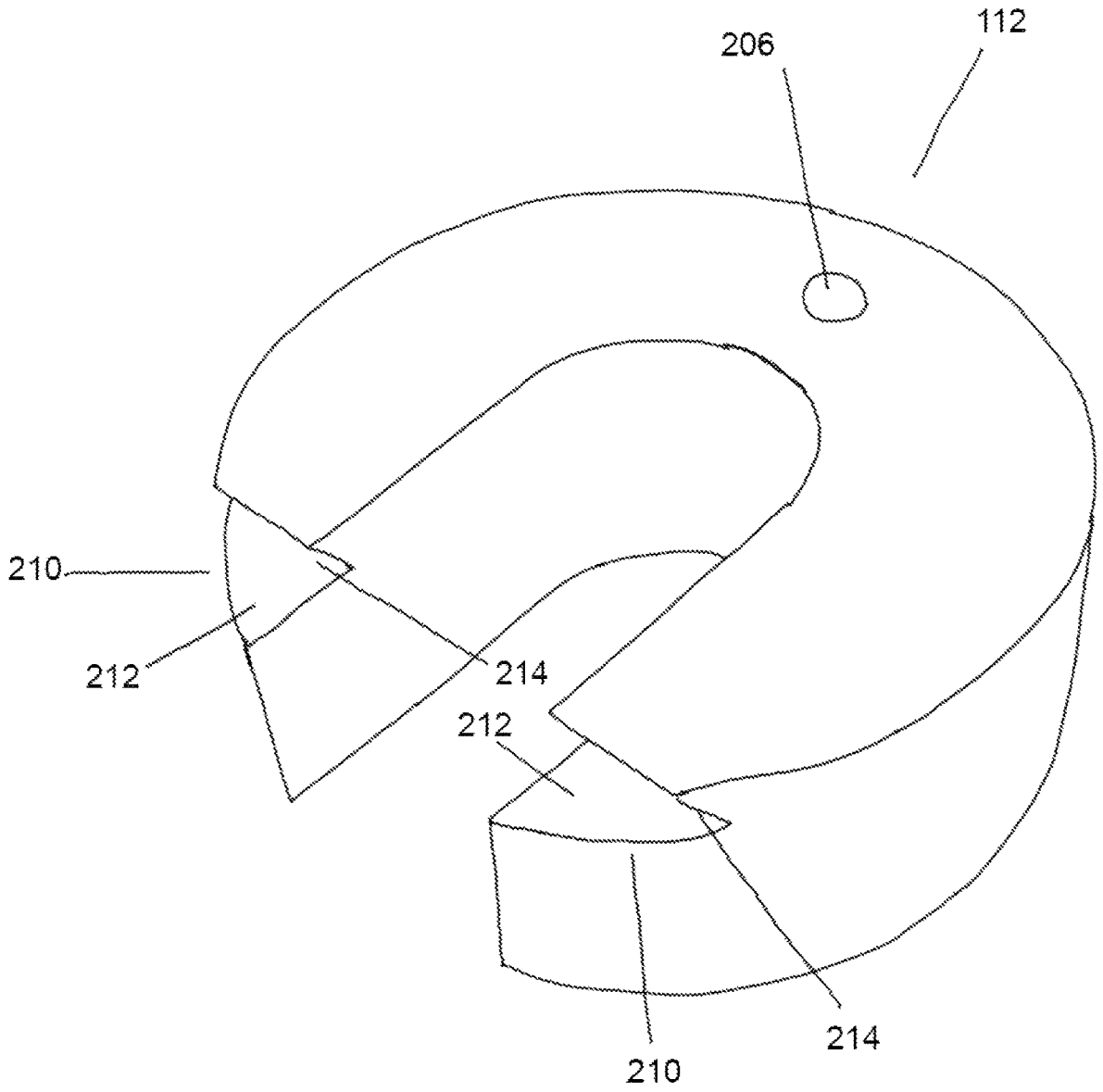
FIG. 12 is a side perspective view of the anode component shown in FIG. 11.
Figure 13:
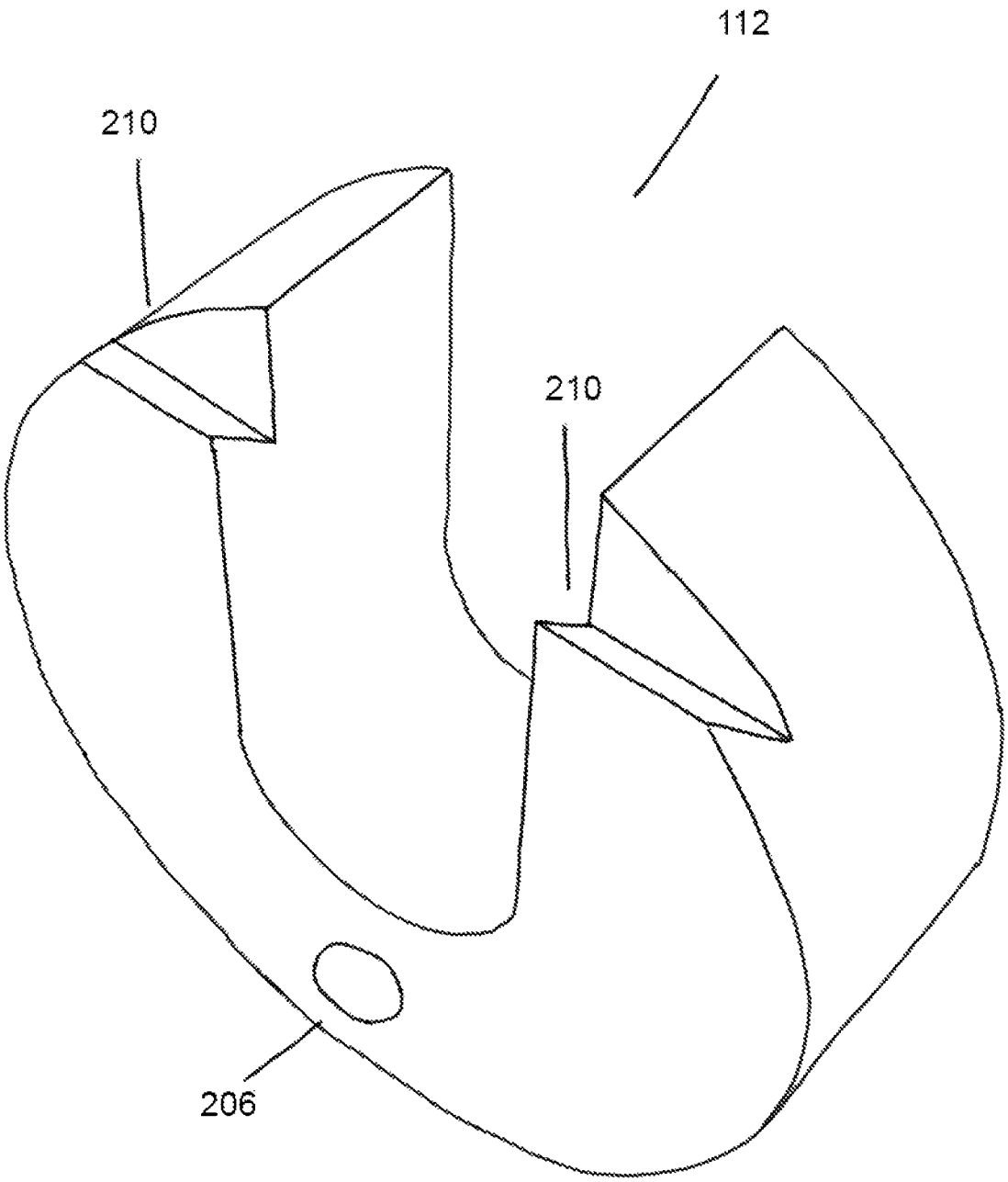
FIG. 13 is a bottom perspective view of the anode component shown in FIG. 11.
Figure 14:
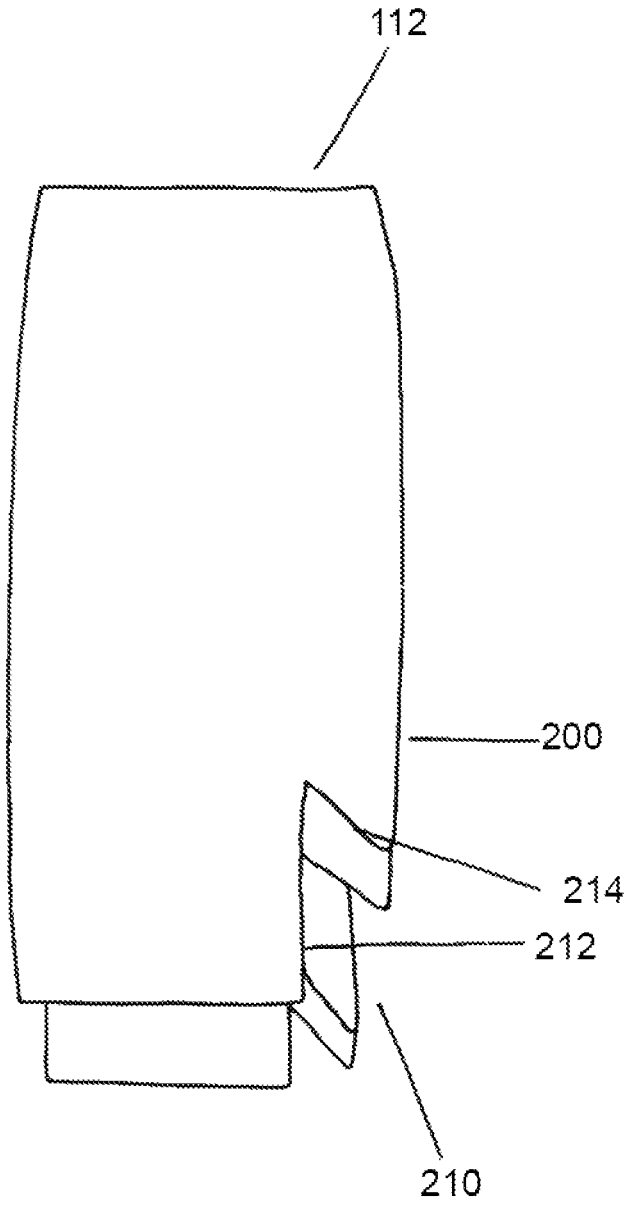
FIG. 14 is a side view of the anode component shown in FIG. 11.

In some embodiments, such as illustrated in FIGS. 11-15, the anode component 112 can comprise mounting recesses 210 that are configured to at least partially receive the protrusions 160 of the mount component 110. The mounting recesses 210 can comprise a top surface 212 and a side surface 214. FIG. 14 illustrates a side view of the mounting recesses 210. As illustrated, the top surface 212 can be oriented generally parallel relative to the rear face 200 of the anode component 112. Further, the side surface 214 can extend transversely relative to the top surface 212. In the illustrated embodiment, the side surface 214 extends at an acute angle relative to the top surface 212. The advantages of such a configuration are discussed herein and provide a degree of engagement between the anode component 112 and the mount component 110.

Moreover, the illustrated embodiments of the mount component 110 and the anode component 112 illustrate a general flat edge, wedge-type shape of the protrusions 160 and the recesses 210. One of the advantages of having a pair of protrusions 160 and a pair of recesses 210 that are symmetrically balanced is that the initial placement of the anode component 112 onto the mount component 110 is generally easier because the geometries are simpler. However, it is possible to configure the protrusions and the recesses to provide shapes other than the flat edge, wedge-type shape shown in the figures. Indeed, myriad other geometries can be used to fit the protrusions into the recesses.

In some embodiments, when the anode component 112 is fitted onto the mount component 110, the top surface 212 can abut the upper surface 162 of the mount component 110, and the side surface 214 can abut the side surface 164 of the mount component 110. Thus, in the illustrated embodiment, the protrusions 160 can be fitted at least partially within the mounting recesses 210 to thereby restrain at least one degree of relative movement between the mount component 110 and the anode component 112.

FIGS. 12-13 illustrate other views of the anode component 112 to further illustrate the configuration of the mounting recesses 210 in this embodiment. The interaction of the protrusions 160 with the mounting recesses 210 is also advantageous because only a single fastening means, such as a mechanical fastener, screw, bolt, clip, frictional coupling, adhesive, weld, and the like, is required to completely restrain relative movement between the anode component 112 and the mount component 110. Thus, removal and installation of the anode component 112 can be exceedingly fast and easy. In use, the mount component 110 is positioned or mounted onto the distal end 18 of the hydraulic unit 10, and the anode component 112 is mounted thereto, used, and replaced in due course by simply removing a single fastening means, such as a mechanical fastener, screw, bolt, clip, frictional coupling, adhesive, weld, or the like.

Figure 15:
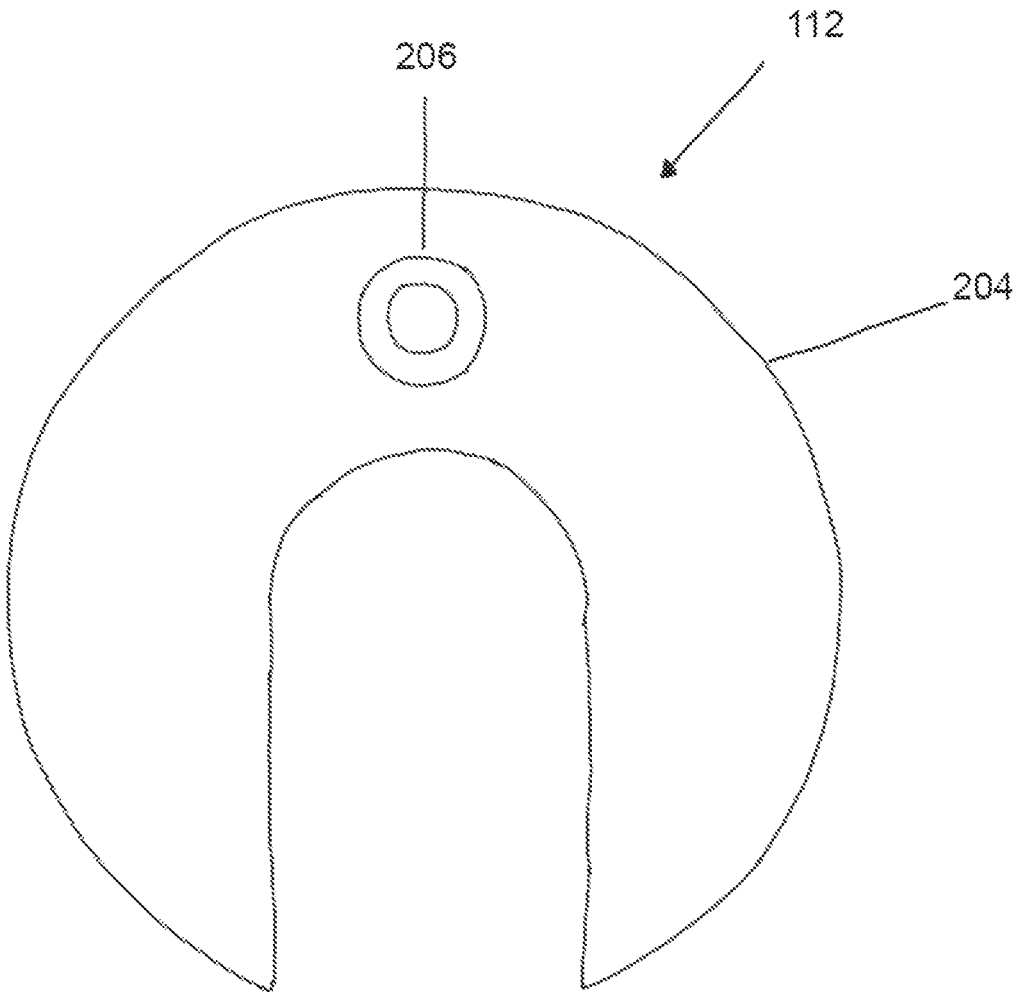
FIG. 15 is a rear view of the anode component shown in FIG. 11.

Additionally, as shown in FIG. 15, the engagement aperture 206 can comprise a counter bore. The counter bore can be configured such that a head of a fastening means, such as a screw, can be received therein and thereby not protrude therefrom. Additionally, the fastening means can comprise a less anodic or non-corrosive washer or other component that is wider than the aperture 206, thus enabling secure engagement between the fastener and the engagement aperture 206. Such a washer can be formed from stainless steel, aluminum, or another less anodic or noncorrosive material, as desired.

FIGS. 16-18 illustrate the anode mount adapter assembly 100 and the interlocking engagement between the mount component 110 and the anode component 112. As illustrated, the protrusions 160 of the mount component can generally mate with the mounting recesses 210 of the anode component 112. Accordingly, the relative movement of these components 110, 112 can be restrained when the anode component 112 is seated against the mount component 110 and a fastening means is inserted through the engagement aperture 206 of the anode component 112 and into the mounting aperture 140 of the mount component 110.

Although the illustrated embodiments have shown that the protrusions 160 are formed as part of the mount component 110 and the mounting recesses 210 are formed as part of the anode component 112, in other embodiments, the protrusions and the recesses can be switched between the mount component 110 and the anode component 112. In other words, some embodiments can be configured such that the anode component comprises protrusions that at least partially engage recesses of the mount component.

Further, the illustrated embodiments show that the assembly can comprise a pair of protrusions and a pair of recesses in order to facilitate the interlocking engagement of the mount component and the anode component. However, embodiments can be provided in which a single protrusion and a single recess are used on the mount component and the anode component.

Furthermore, the axial length of the anode component can be varied to provide sufficient anodic protection to the outboard motor or other device, such as a stern drive, with which the assembly 100 is being used. Additionally, the peripheral shape of the mount component and the anode component can be configured in a shape other than cylindrical. For example, the peripheral shape of the components can be semicylindrical, a rectangular solid, or other three-dimensional shape. Further, the location of the protrusion(s) and recess(es) of the components need not be at a top or bottom end of the assembly. In other words, the protrusion(s) and recess(es) of the components can be centrally located along the components.

Figure 19:
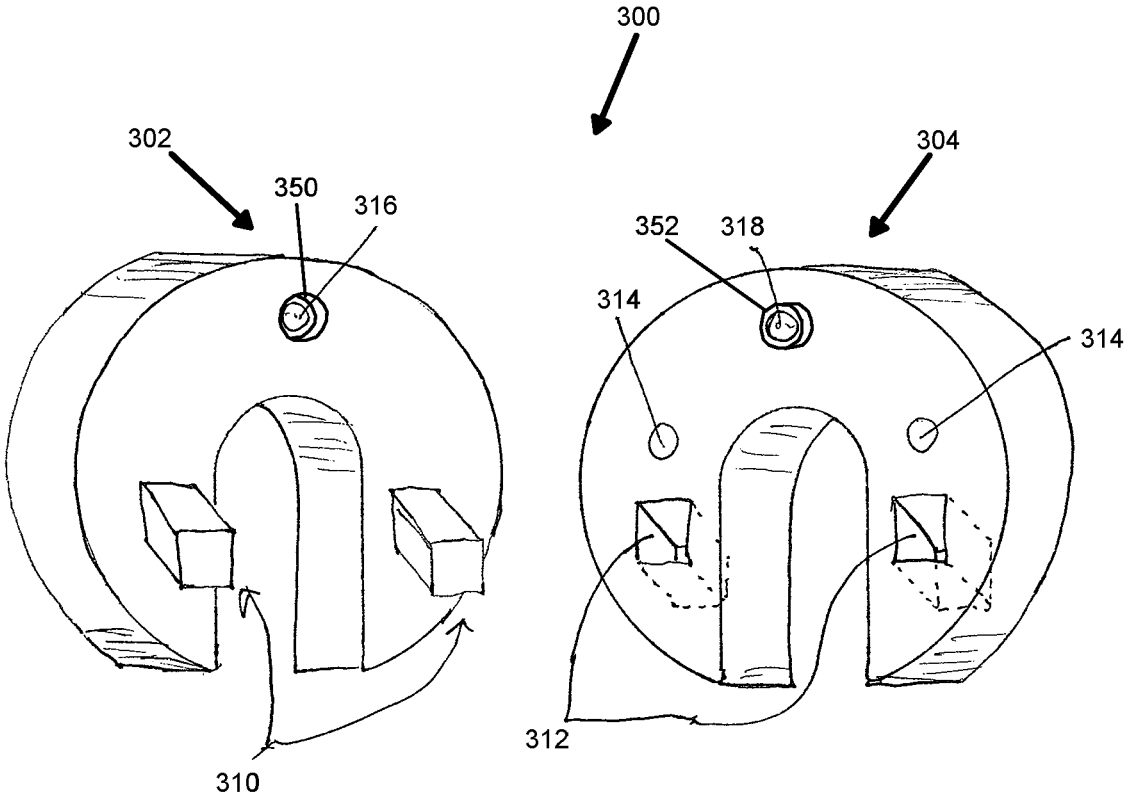
FIG. 19 is a front perspective view of an anode mount adapter assembly, according to another embodiment.

FIG. 19 illustrates another embodiment of an anode mount adapter assembly 300. The assembly 300 can comprise an anode component 302 and a mount component 304. As noted above, although the mount component 304 is attachable to an engine, device, or other component, discussion of the attachment mechanism for attaching the anode component to the mount component applies for mount components that are formed separately or monolithically with the engine, device, or other component. The anode component 302 and the mount component 304 can be used as described above with respect to the assembly 100. However, in this embodiment, the anode component 302 can be configured to comprise protrusions 310 and extend from a body of the anode component 302. These protrusions 310 can be configured to fit into corresponding recesses 312 of the mount component 304. While only a single recess and protrusion pair are essential, other pairs of recesses and protrusions can be used to enhance the engagement between the anode and mount components. The protrusion 310 and recesses 312 can be oriented straight or at an angle relative to a body of the anode component 302 and mount component 304. The protrusions 310 can be at least about 1/16 inch and/or less that or equal to about 1/2 inch. In some embodiments, the protruding portion can be at least about 1/8 inch and/or less that or equal to about 1/4 inch.

FIG. 19 also illustrates that in some embodiments, the anode component 302 can comprise an engagement recess 350. The engagement recess 350 can be configured to receive a protruding portion 352 extending from the top surface of the mount component 304. The protruding portion 352 can be disposed about or adjacent to the mount aperture 318 of the mount component 304. The protruding portion 352 can be at least about 1/16 inch and/or less that or equal to about 1/2 inch. In some embodiments, the protruding portion can be about 1/8 inch. Alternatively, the anode component 302 could be configured to include a protruding portion that is received by a recess formed in the mount component 304 adjacent or about the mount aperture 318.

Accordingly, the assembly 300 can be fitted onto a hydraulic unit with the mount component being fastened thereto using one or more fastening means, such as a mechanical fastener, screw, bolt, clip, frictional coupling, adhesive, weld, and the like. For example, a screw can be disposed through fastening apertures 314 of the mount component 304. Further, the anode component 302 can be seated against the mount component 30 or by inserting the protrusions 310 into the recesses 312. Next, a mechanical fastener, such as a screw, can be placed through a fastening aperture 316 of the anode component 302 and into a mount aperture 318 of the mount component 304.

Figure 20:
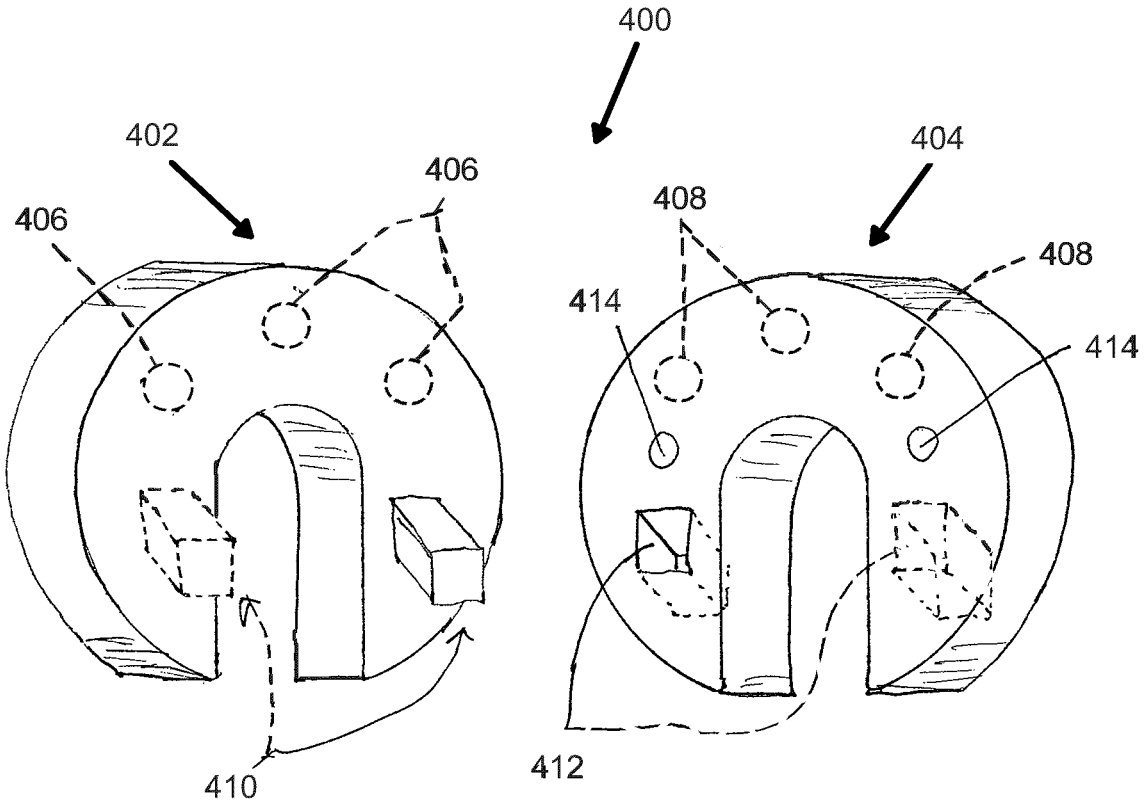
FIG. 20 is a front perspective view of an anode mount adapter assembly, according to yet another embodiment.

FIG. 20 illustrates yet another embodiment of an anode mount adapter assembly 400. The assembly 400 can comprise an anode component 402 and a mount component 404. As noted above, although the mount component 404 is attachable to an engine, device, or other component, discussion of the attachment mechanism for attaching the anode component to the mount component applies for mount components that are formed separately or monolithically with the engine, device, or other component. The anode component 402 and the mount component 404 can be used as described above with respect to the assemblies 100 and 300. For example, the assembly 400 can be fitted onto a hydraulic unit with the mount component being fastened thereto using one or more mechanical fasteners disposed through fastening apertures 414 of the mount component 404. Further, the anode component 402 can be seated against the mount component 404 or by inserting a protrusion 410 into a recess 412.

Additionally, in this embodiment, the anode component 402 can be configured to comprise one or more engagement apertures 406. The engagement apertures 406 can correspond to or cooperate with one or more mounting apertures 408 of the mount component 404. The anode component 402 and the mount component 404 can therefore comprise a plurality of interrelated engagement apertures and mount apertures that are sized and positioned to allow the use of a single fastener to secure the anode component 402 relative to the mount component 404. Each engagement aperture can be paired with a mount aperture such that the single fastener can be inserted into one of a plurality of pairs of engagement and mount apertures. The ability to select a given pair of apertures for use of the fastener can allow greater flexibility and ease of assembly and anode replacement in response to various engine and body arrangements.

For example, in some embodiments, the anode component 402 can comprise a plurality of engagement apertures 406 that are positioned at different locations in the body of the anode component 402. For example, as shown by the dashed lines in FIG. 20, the anode component 402 can comprise three engagement apertures 406 positioned along the upper half of the anode component 402. Further, the mount component 404 can be configured to comprise a plurality of mount apertures 408 that are positioned at different locations in the body of the mount component 404. As shown by the dashed lines in FIG. 20, some embodiments of the mount component 404 can comprise a three mount apertures 408 that are positioned in locations that correspond to the locations of the engagement apertures 406 of the anode component 402. Accordingly, when the anode component 402 and the mount component 404 are positioned next to each other, the mount apertures 408 can line up with the engagement apertures 406 to form three corresponding or interrelated pairs of apertures. Thus, one or more fasteners can be used with any one or more of the pairs of apertures to secure the anode component 402 relative to the mount component 404.

The anode component 402 can comprise one or more protrusions 410 that extend from a body of the anode component 402. These protrusion(s) 410 can be configured to fit into one or more corresponding recesses 412 of the mount component 404. While only a single recess and protrusion pair are essential, other pairs of recesses and protrusions can be used to enhance the engagement between the anode and mount components. The protrusion 410 and recess 412 can be oriented straight or at an angle relative to a body of the anode component 402 and mount component 404. The protrusion 410 can be at least about 1/16 inch and/or less that or equal to about 1/2 inch. In some embodiments, the protruding portion can be at least about 1/8 inch and/or less that or equal to about 1/4 inch.

Accordingly, the interaction of the protrusion and recess pair and a single fastening means can allow the anode component to be quickly and securely mounted onto or dismounted from the mount component. In some embodiments, the cooperation between the protrusion and recess pair and between an interrelated pair of engagement and mounting apertures allows the user to fit the anode component onto the mounting component and create a secure coupling using a single fastening means, such as a single screw.

In some embodiments, the anode component 402 can comprise an engagement recess, as discussed above in FIG. 19. The engagement recess can be configured to receive a protruding portion extending from the top surface of the mount component. The protruding portion can be disposed about or adjacent to the mount aperture of the mount component 404. The protruding portion can be at least about 1/16 inch and/or less that or equal to about 1/2 inch. In some embodiments, the protruding portion can be about 1/8 inch. Alternatively, the anode component 402 could be configured to include a protruding portion that is received by a recess formed in the mount component 404 adjacent or about the mount aperture.

The assemblies 100, 300 illustrate one of the unique features of the embodiments disclosed herein. In some embodiments, the anode component can be securely mounted onto a mount component if the anode component and the mount component are configured to include complementary geometries that allows the mount component to draw the anode component against or closer to the mount component and then to lock the relative positions of the anode component in the mount component by using a single mechanical fastener, such as a screw. In some embodiments, the end of the anode component can be drawn into the mount component by means of an angled protrusion/recess structural combination of the anode component and the mount component. This unique structural advantage can allow the anode component to be pulled into the mount component by a simple movement that is assisted by gravity, which further facilitates removal and replacement of the anode component. Further, the complementary geometries of the protrusion/recess structures can serve to restrict one or more degrees of motion and the mechanical fastener can serve to restrict other degrees of motion, thereby fixing the relative positioning of the anode component and the mount component.

With regard to some of the embodiments disclosed herein, the angled relationship of the protrusions/recesses relative to the bodies of the mount component and/or the anode component can be configured so as to provide sufficient mechanical coupling strength and a sufficient ability for the mount component to draw in or pull in the anode component. Protrusion or recess structural components can be configured such that eventual erosion of the anode component does not deteriorate the strength of the engagement between the end of component in the mount component. For example, in an embodiment wherein the protrusions extend from the body of the anode component, the protrusion should be configured to be sufficiently large such that the protrusions will continue to serve in securing the anode component to the mount component until the anode component requires replacement. Thus, the protrusion ends in such an embodiment should not fail before the useful life of the anode component is reached. Additionally, the configuration of the protrusion/recess structural components can be configured such that when the protrusions are initially placed into the recesses, the weight of the anode component causes engagement between the protrusions in the recesses, whether the protrusions are extending from the anode component or the mount component.

According to various embodiments, methods of installing the anode mount adapter assembly and its components discussed above also represent a portion of the inventive disclosure provided herein. The use of the components and features of these components represent inventive methods and procedures that are unique and novel over prior art maintenance procedures. Accordingly, the present inventions also comprise methods of removing and replacing the anode mount adapter assembly and/or its components, as discussed above.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An anode mounting device, comprising:
- a. an anode component;
- b. a mount component comprising:
  - i. a mount component body;
    - 1. having at least one protrusion or recess with a length of less than or equal to a half of an inch extending from a front surface of the mount component body;
    - 2. wherein the protrusion or recess is configured to engage a recess or protrusion of the anode component for restricting movement of the anode component with respect to the mount component in a rotational, downward, and side to side direction of movement to prevent gravitational disengagement;
    - 3. the mount component body comprising at least one mounting aperture disposed therein, the mounting aperture of the mount component body being configured to receive a fastener for securing the anode component to the mount component, the fastener restricting at least one additional degree of movement of the anode component with respect to the mount component to thereby secure the anode component to the mount component;
- c. wherein the anode component is made of a more anodic material than the mount component; and
- d. wherein the anode component and the mount component have the same diameter.

2. The anode mounting device of claim 1, wherein the mount component comprises a pair of protrusions configured to engage with corresponding recesses of the anode component.

3. The anode mounting device of claim 2, wherein the mount component also comprises:
- a. a top end and a bottom end wherein the front surface is substantially flat except for the pair of protrusions; and
- b. the pair of protrusions extend upwardly from the front surface and the bottom end of the mount component body.

4. The anode mounting device of claim 3, wherein the protrusions comprise an angled surface for enabling the mount component to draw the anode component toward the front surface of the mount component body.

5. The anode mounting device of claim 4, wherein:
- a. the outer surface of the mount component body is generally cylindrical and the protrusions of the mount component are disposed adjacent to a circular periphery on the bottom end of the mount component body.

6. The anode mounting device of claim 3, wherein the protrusions of the mount component body extend from a generally central location on the front surface of the mount component body.

7. The anode mounting device of claim 1, wherein the mount component comprises a protruding portion extending from the front surface about a mounting aperture formed in the mount component body, the protruding portion being configured to engage with a recess of the anode component for securing the anode component relative to the mount component.

8. The anode mounting device of claim 1, wherein the mount component is formed separately from a structure to which the anode mount adapter is attached or bonded.

9. The anode mounting device of claim 5, wherein the mount component comprises at least one fastener aperture, the fastener aperture being configured to receive a fastener for mounting the mount component to the structure.

10. An anode mounting device comprising:
- a. a mount component;
- b. an anode component, comprising;
  - i. an anode component body with a top end, a bottom end, a front surface, and a back surface;
  - ii. the anode component body having at least one protrusion or recess formed therein;
  - iii. the protrusion or recess being on the bottom end and on the front surface of the anode component body;

iv. wherein the protrusion or recess is configured to engage a recess or protrusion of a mounting component for restricting movement of the anode component with respect to the mount component in a rotational, downward, and side to side direction of movement to prevent gravitational disengagement;

v. the anode component body comprising at least one engagement aperture disposed therein, the engagement aperture being configured to receive a fastener for securing the anode component to the mount component, the fastener restricting at least one additional direction of movement of the anode component with respect to the mount component to thereby secure the anode component to the mount component; and vi. wherein the protrusion or recess has a length of less than or equal to a half of an inch;

c. wherein the mount component is made of a less anodic material than the mount component.

11. The anode mounting device of claim 10, wherein the anode component comprises a pair of recesses configured to receive corresponding protrusions of the mount component.

12. The anode mounting device of claim 11, wherein the recesses comprise an angled surface for enabling the anode component to be drawn in toward the mount component.

13. The anode mounting device of claim 12, wherein the anode component comprises an engagement recess disposed about the engagement aperture, the engagement recess being configured to receive a protruding portion extending from the mount component.

14. The anode mounting device of claim 13, wherein the outer surface of the anode component body is generally cylindrical and the recesses are disposed adjacent to a circular periphery of the anode component body wherein:

a. the circular periphery is on the bottom end of the anode component body;

b. the circular periphery extends from the bottom end to a mid-point in the anode component body;

c. the circular periphery extends through the anode component body perpendicular to the front surface and back surface of the anode component body from the front surface to the back surface of the anode component body; and d. the engagement aperture extends parallel to the circular periphery from the front surface to the back surface of the anode component body.

15. The anode mounting device of claim 10, wherein the anode component comprises a pair of protrusions configured to engage with corresponding recesses of the mount component.

16. A method of replacing a sacrificial anode component comprising:

a. a first aligning step wherein one or more recesses that is less than or equal to a half of an inch of an anode component is aligned against one or more protrusions that is less than or equal to a half of an inch of a mount component that is made of a less anodic material than the anode component;

b. engaging the one or more recesses of the anode component with the one or more protrusions of the mount component for restricting movement of the anode component with respect to the mount component in a rotational, downward, and side to side direction of movement to prevent gravitational disengagement;

c. a second aligning step wherein an engagement aperture of the anode component is aligned with a mounting aperture of the mount component; and d. coupling the anode component to the mount component by passing a fastener through the engagement aperture and into the mounting aperture.

17. The method of claim 16, wherein the first aligning step comprises aligning a pair of protrusions of the mount component with a pair of recesses of the anode component.

18. The method of claim 16, wherein the engaging step comprises engaging a pair of protrusions of the mount component with a pair of recesses of the anode component.

19. The method of claim 16, further comprising engaging an engagement recess disposed about the engagement aperture of the anode component with a protruding portion extending about the mounting aperture of the mount component.

* * * * *